US011998146B2

(12) United States Patent
Van Ert et al.

(10) Patent No.: US 11,998,146 B2
(45) Date of Patent: Jun. 4, 2024

(54) MAGNETICALLY MOUNTED SHOWER ITEMS

(71) Applicants: Kelly Van Ert, Bemidji, MN (US); Wesley Van Ert, Bemidji, MN (US)

(72) Inventors: Kelly Van Ert, Bemidji, MN (US); Wesley Van Ert, Bemidji, MN (US)

( * ) Notice: Subject to any disclaimer, the term of this patent is extended or adjusted under 35 U.S.C. 154(b) by 0 days.

(21) Appl. No.: 17/685,121

(22) Filed: Mar. 2, 2022

(65) Prior Publication Data

US 2022/0279984 A1 Sep. 8, 2022

Related U.S. Application Data

(60) Provisional application No. 63/155,919, filed on Mar. 3, 2021.

(51) Int. Cl.

| | |
|---|---|
| ***A47K 3/28*** | (2006.01) |
| ***A47B 96/06*** | (2006.01) |
| ***E03C 1/06*** | (2006.01) |

(52) U.S. Cl.
CPC ..... *A47K 3/281* (2013.01); *A47B 96/06* (2013.01); *E03C 1/066* (2013.01)

(58) Field of Classification Search
CPC ..... A47K 3/281; A47B 96/06; E03C 1/066; A47G 29/08
See application file for complete search history.

(56) References Cited

U.S. PATENT DOCUMENTS

| | | | | |
|---|---|---|---|---|
| 3,239,178 A | 3/1966 | Pompa | | |
| 5,064,159 A | 11/1991 | Kotick | | |
| 5,065,879 A * | 11/1991 | King | B65D 81/3886 | 220/907 |
| 5,941,434 A * | 8/1999 | Green | A45F 5/02 | 224/195 |
| 6,286,798 B1 * | 9/2001 | Chun | A47G 23/0216 | 220/907 |
| 6,594,832 B2 | 7/2003 | Yang | | |
| 7,021,594 B2 * | 4/2006 | Exler | A47G 23/0225 | 248/205.2 |

(Continued)

FOREIGN PATENT DOCUMENTS

| | | |
|---|---|---|
| CN | 2253116 | 4/1997 |
| CN | 2520207 | 11/2002 |

(Continued)

OTHER PUBLICATIONS

"Magnetic Shower Dock", Purity (Xiamen) Sanitary Ware Co., Ltd., 2022, 4 pages, available at https://ifdesign.com/en/winner-ranking/project/magnetic-shower-dock/313955.

*Primary Examiner* — Ko H Chan
(74) *Attorney, Agent, or Firm* — MERCHANT & GOULD

(57) ABSTRACT

A magnetic shower item mounting system includes a magnetic board configured to be installed on a shower wall. The magnetic board has a magnetic section and an installation section. The system can include a magnetic sleeve configured to wrap around a shower item, with the sleeve having a tubular section, a magnetic insert encapsulated by a water resistant grip material with a slip-resistant texture, and the sleeve is adjustable to tighten the tubular section around the shower item. The magnetic insert magnetically attaches the sleeve to the magnetic section of the magnetic board to attach the shower item to the magnetic board.

2 Claims, 21 Drawing Sheets

(56) References Cited

U.S. PATENT DOCUMENTS

| | | | | |
|---|---|---|---|---|
| 8,656,674 | B1 * | 2/2014 | Woodward | E04F 13/142 52/388 |
| 9,758,080 | B2 | 9/2017 | Goldman | |
| 9,919,331 | B2 | 3/2018 | Scheffer et al. | |
| 10,165,906 | B1 * | 1/2019 | Beychok | A61L 9/12 |
| 10,820,731 | B2 | 11/2020 | Adjeleian | |
| 10,947,422 | B1 * | 3/2021 | Matich | B32B 29/005 |
| 11,096,531 | B2 * | 8/2021 | Edwards | A47K 17/024 |
| 2007/0176069 | A1 | 8/2007 | Mitchell | |
| 2015/0230667 | A1 * | 8/2015 | Palazzolo | E03C 1/18 4/654 |
| 2018/0338651 | A1 * | 11/2018 | Burtt | A47K 3/281 |
| 2019/0014894 | A1 * | 1/2019 | Hancock | A45F 5/10 |
| 2019/0335883 | A1 * | 11/2019 | Fisher | A45F 5/021 |
| 2021/0274956 | A1 * | 9/2021 | Albrecht | A47G 25/12 |

FOREIGN PATENT DOCUMENTS

| | | | |
|---|---|---|---|
| CN | 203170505 | | 9/2013 |
| CN | 203470251 | | 3/2014 |
| CN | 104594462 | | 5/2015 |
| CN | 107752858 | | 3/2018 |
| CN | 107761840 | | 3/2018 |
| CN | 211865489 | | 11/2020 |
| DE | 202004016497 | | 12/2004 |
| DE | 202012004126 | | 5/2012 |
| DE | 102012213184 | | 10/2012 |
| DE | 202012103207 | | 8/2013 |
| DE | 202018005635 | | 1/2019 |
| DE | 202018006158 | | 5/2019 |
| DE | 202019005476 | | 9/2020 |
| EP | 3488746 | | 5/2019 |
| FR | 1148426 | | 12/1957 |
| FR | 3013366 | | 5/2015 |
| GB | 1303959 | | 1/1973 |
| GB | 2517120 | | 2/2015 |
| JP | 09-075253 | | 3/1997 |
| JP | 2011001718 | A * | 1/2011 |
| KR | 1020100106877 | | 4/2010 |
| WO | 2008107102 | | 9/2008 |
| WO | 2008107103 | | 9/2008 |
| WO | 2016096739 | | 6/2016 |

* cited by examiner

MAGNETICALLY MOUNTED SHOWER ITEMS

FIELD

This technical disclosure relates to systems and devices for magnetically mounting personal hygiene items, bathroom hardware, and accessories onto the walls of a showering or bathing area using one or more magnetic elements and one or more magnetic mounting boards embedded into or mounted on the walls.

BACKGROUND

Shower items, such as showerheads or bottles of soap are commonly placed in a showering or bathing area (referred to collectively as a shower area). The shower area usually includes at least a showerhead directly mounted to a particular height on the wall or placed in a holder that is mounted to the wall. The shower area can include a shelving unit mounted to the wall for holding other shower items, such as a bottle of soap or shampoo.

SUMMARY

This technical disclosure relates to systems and devices for magnetically mounting personal hygiene items, bathroom hardware, and accessories onto the walls of a showering or bathing area using one or more magnetic elements and one or more magnetic mounting boards embedded into or mounted on the walls.

A shower item, such as a showerhead, a bottle of soap, shampoo, or conditioner, a long handled sponge, a razor, or the like, can be held magnetically on a magnetic board installed to a shower wall. The shower item can be magnetically mounted anywhere on the magnetic board. This flexibility can provide mounting locations in the shower individualized to the user and thus improve user accessibility and safety. For example, it is more comfortable and safer for a person who has to sit in the shower to move the mounted shower items to a lower position on a shower wall. The lower position reduces the need for reaching up in the shower. Whereas, it is more comfortable and safer for a person who stands in the shower to move the mounted shower items to a higher position on the shower wall. The higher position reduces the need for bending over and reaching down for items in the shower. The options of moving the mounting positions according to individual needs can promote shower safety and independence especially for users with limited mobility, such as elderly adults or people with disabilities. For example, users that can benefit from moving the magnetically mounted shower items to their desired locations may have limited mobility for reasons such as: arthritis, carpal tunnel, reduced functional grasp, weak hands, decreased shoulder movement, generalized weakness, or the like. Furthermore, the mounting element, such as a magnetic sleeve or a set of zip-ties can act as paddings and/or create ridges on a shower item. The paddings or ridges can make it easier for a user with a weaker grip to hold onto the shower item.

A system described herein can include a magnetic board installed in a shower with at least one magnetic sleeve that can hold a shower item. For example, a handheld showerhead or a shampoo bottle can be wrapped in the magnetic sleeve and placed anywhere on the magnetic board. Then, a second user can easily move the magnetic sleeve wrapped showerhead or shampoo bottle to a different location on the magnetic board that is more accessible and safer for the second user. The magnetic board can have any size that is suitable to allow mounting of multiple magnetic items, and allow adjustment of the mounting locations of the shower items on the magnetic board. The magnetic board can have any shape including but not limited to, square, rectangular, triangular, round, and the like. In one embodiment, the magnetic board can be square and can measure about 2.0 feet by about 2.0 feet. In another embodiment, the magnetic board can be square and measure about 1.0 feet by about 1.0 feet.

According to an embodiment, a magnetic shower item mounting system can include a magnetic board configured to be installed on a shower wall, with the magnetic wall having a magnetic section and an installation section. A magnetic sleeve is configured to wrap around a shower item, with the magnetic sleeve having an adjustable tubular section, at least one magnetic insert encapsulated by a water resistant grip material with a slip-resistant texture, and an adjustable fastener configured to tighten the adjustable tubular section around the shower item. The at least one magnetic insert is magnetically attracted to the magnetic section of the magnetic board and magnetically attaches the shower item to the magnetic board. The adjustable fastener can include a tension portion and a control portion.

According to another embodiment, the magnetic board can include at least one magnetic tile that is configured to be embedded into the shower wall together with other, non-magnetic tiles forming the shower wall.

According to yet another embodiment, the installation section of the board may be configured to attach the magnetic board to the wall using, for example, at least one of a polyurethane adhesive tape, an adhesive, one or more suction cups (such as one or more vacuum suction cups), or a hole configured to receive a wall fastener and a removable cap configured to cover the hole.

According to yet another embodiment, the magnetic sleeve can further include an open top end and an open bottom end, and the tension portion can include a lace, a zip-tie, a wire, or a cable wrapped around the adjustable tubular section.

According to yet another embodiment, the control portion can include a dial connected to the tension portion and that adjusts the tension of the tension portion around the adjustable tubular section.

According to yet another embodiment, the adjustable tubular section can include an elongated member having a first end that is attachable to a second end by the adjustable fastener, and the tension portion and the control portion include hook and loop type fasteners disposed respectively at the first end and the second end of the elongated member.

According to yet another embodiment, the magnetic sleeve can further include an open top end and a perforated bottom end. The perforated bottom end includes a base material and one or more perforations configured to drain water.

According to yet another embodiment, the adjustable fastener can comprise at least one of a piece of hook and loop fastener, a ripcord, a dial, a zip-tie, or a magnetic zip-tie.

According to yet another embodiment, the magnetic sleeve can further include at least one of a gripping cuff or an alert button attached to the magnetic sleeve.

According to yet another embodiment, the adjustable tubular section can include a foam sleeve and a partially attached foam bottom, and the adjustable fastener can include at least one of a hook and loop fastener, a ripcord, a dial, or a magnetic zip-tie, and the adjustable fastener is positioned at a top end of the adjustable tubular section.

According to yet another embodiment, the adjustable tubular section can include the foam sleeve and the partially attached foam bottom so that the adjustable tubular section functions as a magnetic koozie.

According to yet another embodiment, the adjustable tubular section can include at least one magnetic zip-tie wrapped around the shower item. According to yet another embodiment, each of the magnetic zip-ties can include a ratchet affixed to a bar that extends along a direction generally parallel to a longitudinal direction of the shower item.

According to yet another embodiment, the tubular section includes an elongated member having a first end attachable to a second end by the adjustable fastener. The tension portion attaches the control portion to the tubular section at the first end and the second end of the tubular section. The control portion includes a dial configured to turn a core in one direction so as to wrap the tubular section tighter against the shower item and to turn the core in an opposite direction to unwrap the tension portion.

According to one embodiment, a magnetic shower item mounting system includes a magnetic board, which can be a plate affixed to the wall or one or more magnetic tiles, configured to be installed on a shower wall, where the magnetic board has a magnetic section and an installation section. The system can include a magnetic medallion having a magnetic piece fixed on a medallion base at one end with an adhesive end configured to adhere the magnetic medallion to a first shower item. The magnetic piece is magnetically attracted to the magnetic section of the magnetic board and magnetically attaches the first shower item to the magnetic board. The system can include one or more of the magnetic sleeves.

According to yet another embodiment, the adjustable tubular section can include at least one zip-tie wrapped around the shower item.

According to yet another embodiment, each of the zip-ties can include a ratchet affixed to a bar that extends along a direction generally parallel to a longitudinal direction of the shower item.

DRAWINGS

DETAILED DESCRIPTION

This technical disclosure relates to systems and devices for magnetically mounting personal hygiene items, bathroom hardware, and accessories onto the walls of a showering or bathing area using one or more magnetic elements and one or more magnetic mounting boards embedded into or mounted on the walls.

Figure 1:
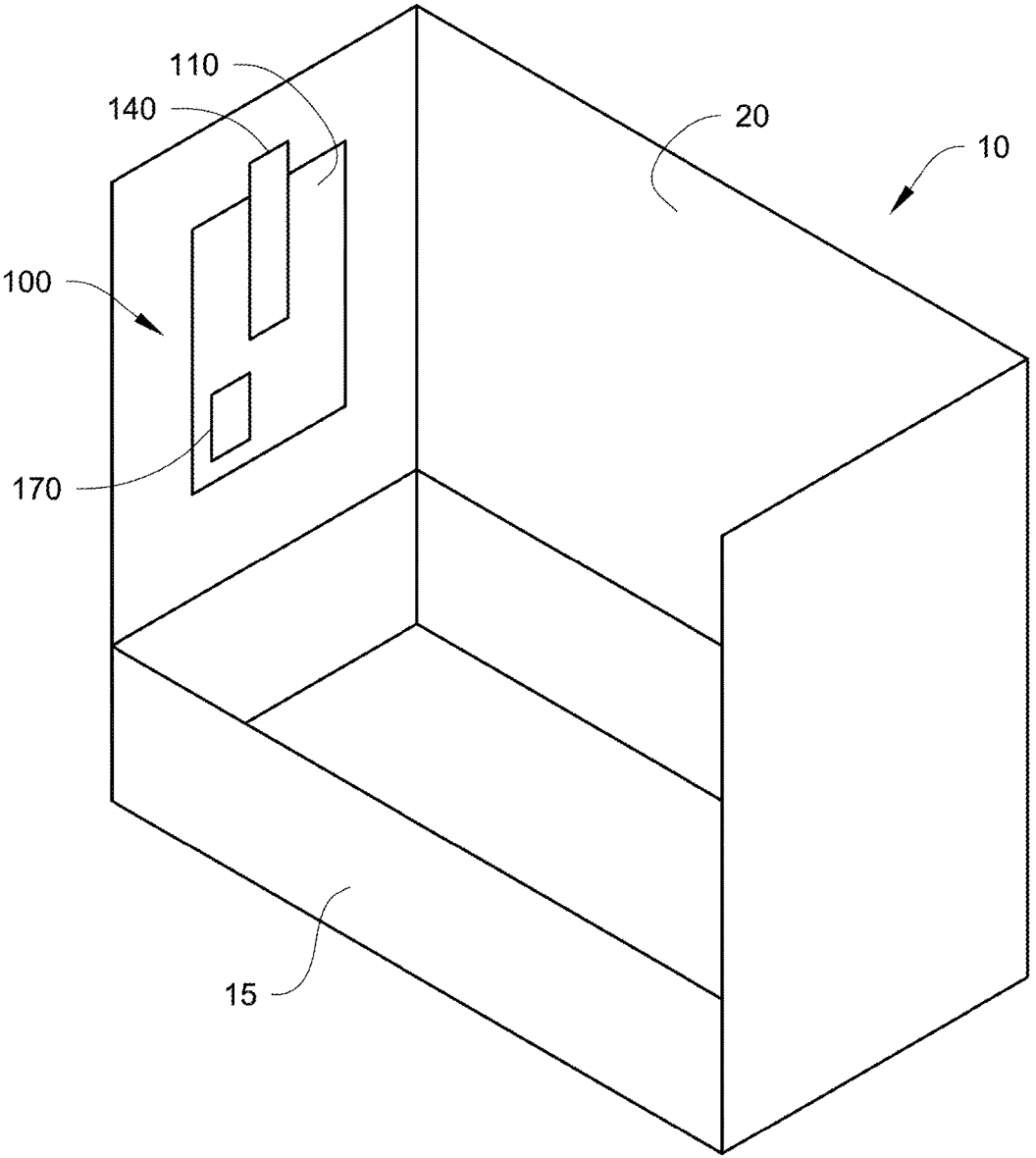
FIG. 1 is a schematic view of a showering area including a mounting system, according to an embodiment.

FIG. 1 is a schematic view of a showering area 10 including a mounting system 100, according to an embodiment. The showering area 10 is a facility where a user can take a shower. The showering area 10 can include a base 15 that collects water used during a shower and drains the waste water away from the showering area 10. The base 15 can be a bathtub or a shower pan with a drainage system attached. The base 15 can be surrounded by one or more panels of shower walls 20. The shower walls 20 provide privacy to the user and a mounting surface for shower items, such as a showerhead, holders for personal hygiene items or products, such as bottles of soap, shampoo, or conditioner, long handled sponges, razors, or the like. The walls 20 can be formed by a water-proof material such as ceramic tiles, plastic panels, or the like.

The mounting system 100, alternatively referred to as the magnetic shower items mounting system 100, holds shower items, such as a showerhead or a shampoo bottle, without the user actively holding them. The mounting system 100 can include a magnetic mounting board 110 and one or more magnetic sleeves 140. The system 100 can further include a second magnetic sleeve 170.

The board 110 serves as a mounting surface for the magnetic sleeves 140 and 170. The board 110 has a first side facing the center of the showering area 10 and second side facing a section of the wall 20 where the board 110 is installed. The first side is relatively flat so that the first and second magnetic sleeves 140 and 170 can be placed anywhere on the first side of the board 110. The second side is directly attached to the wall 20 or attached to the wall 20 through one or more wall fasteners. The board 110 includes a magnetic section and an installation section (shown in FIG.

3). According to one embodiment, the magnetic section and the installation section can partially or fully overlap on the board 110.

The magnetic section is made from a magnetic material such that the magnetic section of the board 110 can attract another magnetic object such that the magnetic object can be held on the magnetic section of the board 110 by magnetism. According to one embodiment, the magnetic section of the board 110 can be made from a permanent magnet that creates a magnetic field, and the magnetic object contains a ferrous metal that is attracted to the magnetic section of the board 110. According to another embodiment, the magnetic object contains a permanent magnet and the board 110 contains a ferrous metal. According to yet another embodiment, both the magnetic section of the board 110 and the magnetic object contains magnets, and their respective polarities are configured so that the magnetic object is attracted to the first side of the board 110. According to yet another embodiment, the board has a size of at least 2 feet tall by at least 2 feet wide.

The installation section of the board 110 attaches the board 110 onto the wall 20. The installation section includes or attaches to one or more wall fasteners, such as a polyurethane adhesive tape, a liquid or solid adhesive, one or more suction cups, or the like. According to one embodiment, the wall fastener can be one or more through holes on the board 110. The holes are sized to receive a wall fastener, such as a screw, a nail, or the like. According to one embodiment, the installation section is positioned in an area near each corners of the board 110.

The magnetic sleeves 140 and 170 can be tightened around a tubular portion of a shower item, such as a bottle or the handle of a handheld showerhead, and the magnetic object(s) embedded in the magnetic sleeves 140 and 170 can hold the bottle or the showerhead on the surface of the board 110 by magnetism. According to one embodiment, the system 100 can include one or more of the magnetic sleeves 140, 170. According to another embodiment, the magnetic sleeves 140 and 170 are made to be the same size and use the same materials. According to yet another embodiment, the magnetic sleeves 140 and 170 are made to different sizes, or made using different materials or configurations.

Figure 2:
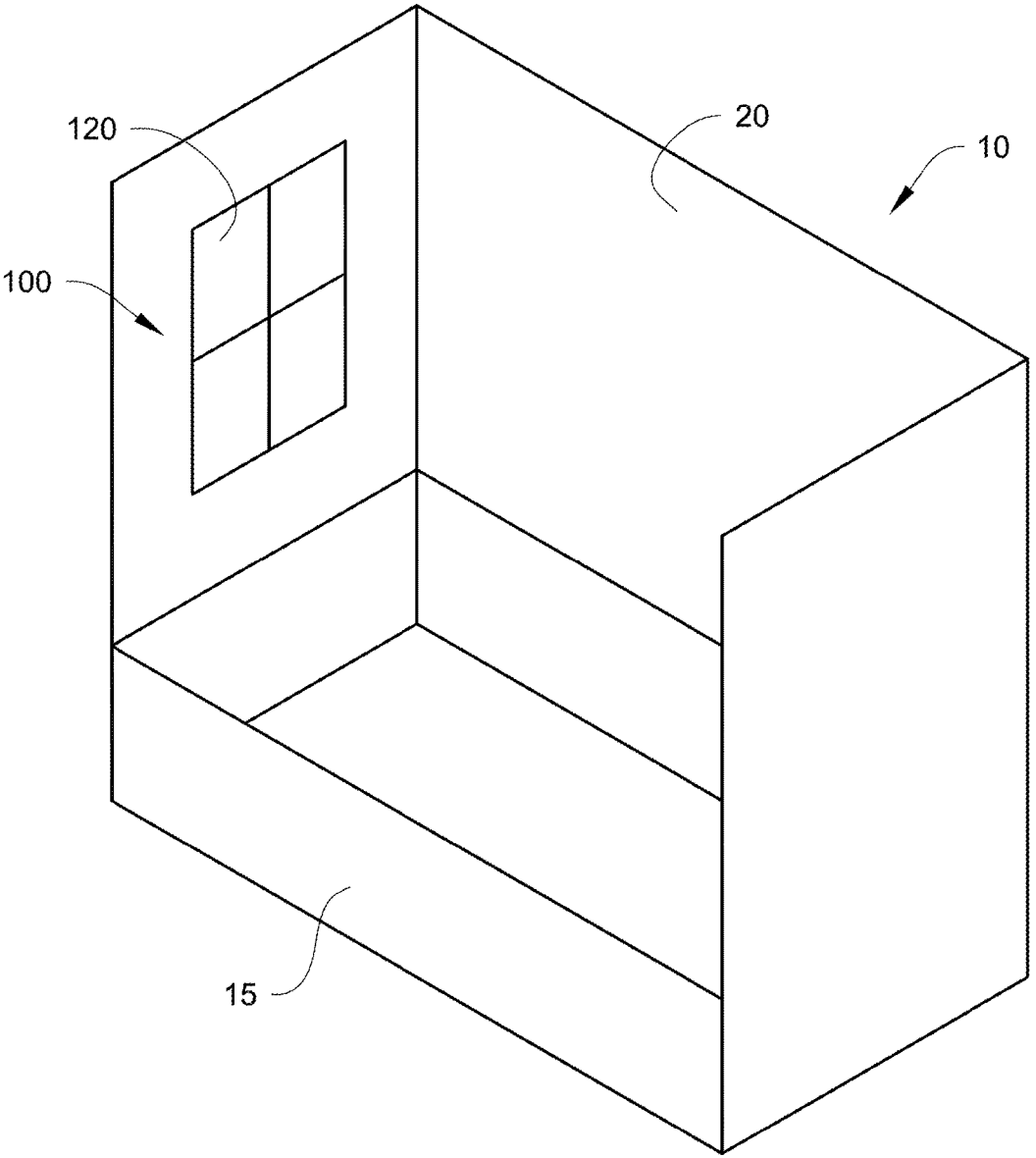
FIG. 2 is a schematic view of a showering area including a mounting system, according to another embodiment.

FIG. 2 is a schematic view of a showering area 10 including a mounting system 100, according to another embodiment. The showering area 10 can include the base 15 and the walls 20, as shown and described in FIG. 1. The showering area 10 can further include a mounting system 100 that includes one or more magnetic tiles 120 installed onto the walls 20 along with other, non-magnetic tiles, performing the function of the board 110 as shown and described in FIG. 1. The magnetic tiles 120 can be tiles made with a magnetic material that attracts or is attracted to a magnet or a ferrous metal. The tiles 120 are installed or embedded into the wall 20 using a wall fastener, such as a liquid or a solid adhesive, mortar, or the like.

Figure 3A:
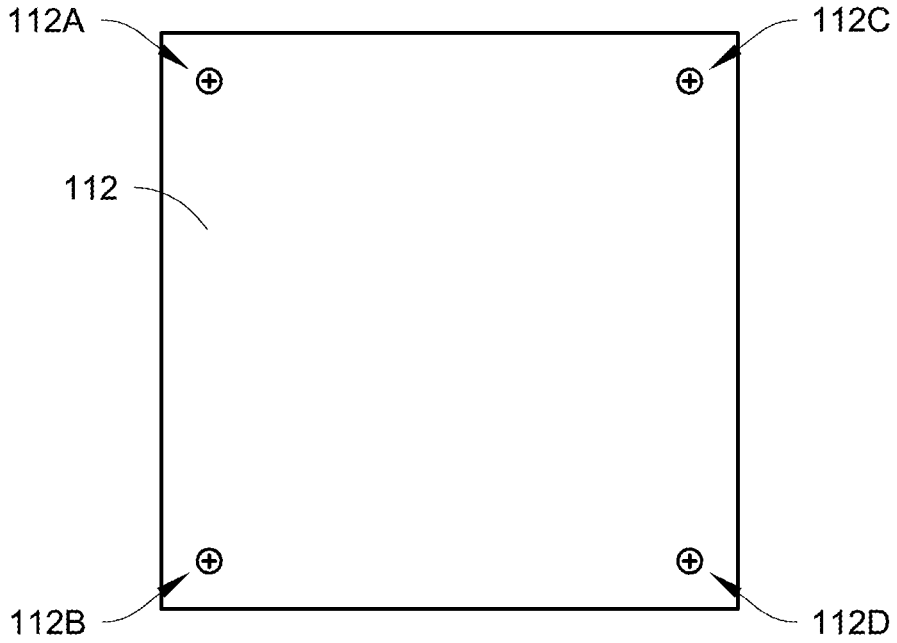
FIG. 3A is a front view of a magnetic board of the mounting system, according to an embodiment.

FIG. 3A is a front view of a magnetic board 112 of the mounting system 100, according to an embodiment. As shown in FIG. 3A, the board 112 has a rectangular, in particular square, shape with installation sections 112A-D near each corner of the board 112. The installation sections 112A-D attach the board 112 to the shower walls (shown in FIGS. 1 and 2 as the walls 20). According to one embodiment, the installation sections 112A-D are attached to the walls by wall fasteners, such as screws 113 (see FIG. 3B), in a through hole.

According to one embodiment, the entire area of the first face of the board 112 can be magnetic such that a magnetic object can be magnetically attached to any portion of the board 112. According to another embodiment, only a portion of the first face of the board 112 is magnetic. According to another embodiment, the board 112 can be the board 110 as shown and described in FIG. 1.

Figure 3B:
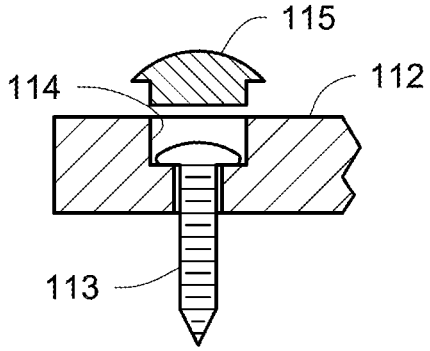
FIG. 3B is a cross-sectional view of the magnetic board of FIG. 3A at one of the installation section, according to one embodiment.

FIG. 3B is a cross-sectional view of the magnetic board 112 at one of the installation sections, according to one embodiment. As shown in FIG. 3B, the first surface of the board includes a counterbored hole 114 to receive the head of the screw 113. The counterbored hole 114 is covered by a cap 115 that prevents water from entering into the counterbored hole 114 and causing water damage to the screw 113 or the wall 20. According to one embodiment, the cap 115 can be a rubber cover that seals the hole.

Figure 3C:
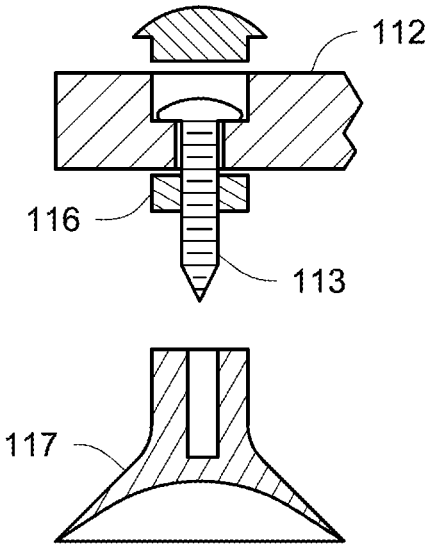
FIG. 3C is cross-sectional view of the magnetic board of FIG. 3A at one of the installation section, according to another embodiment.
Figure 20:
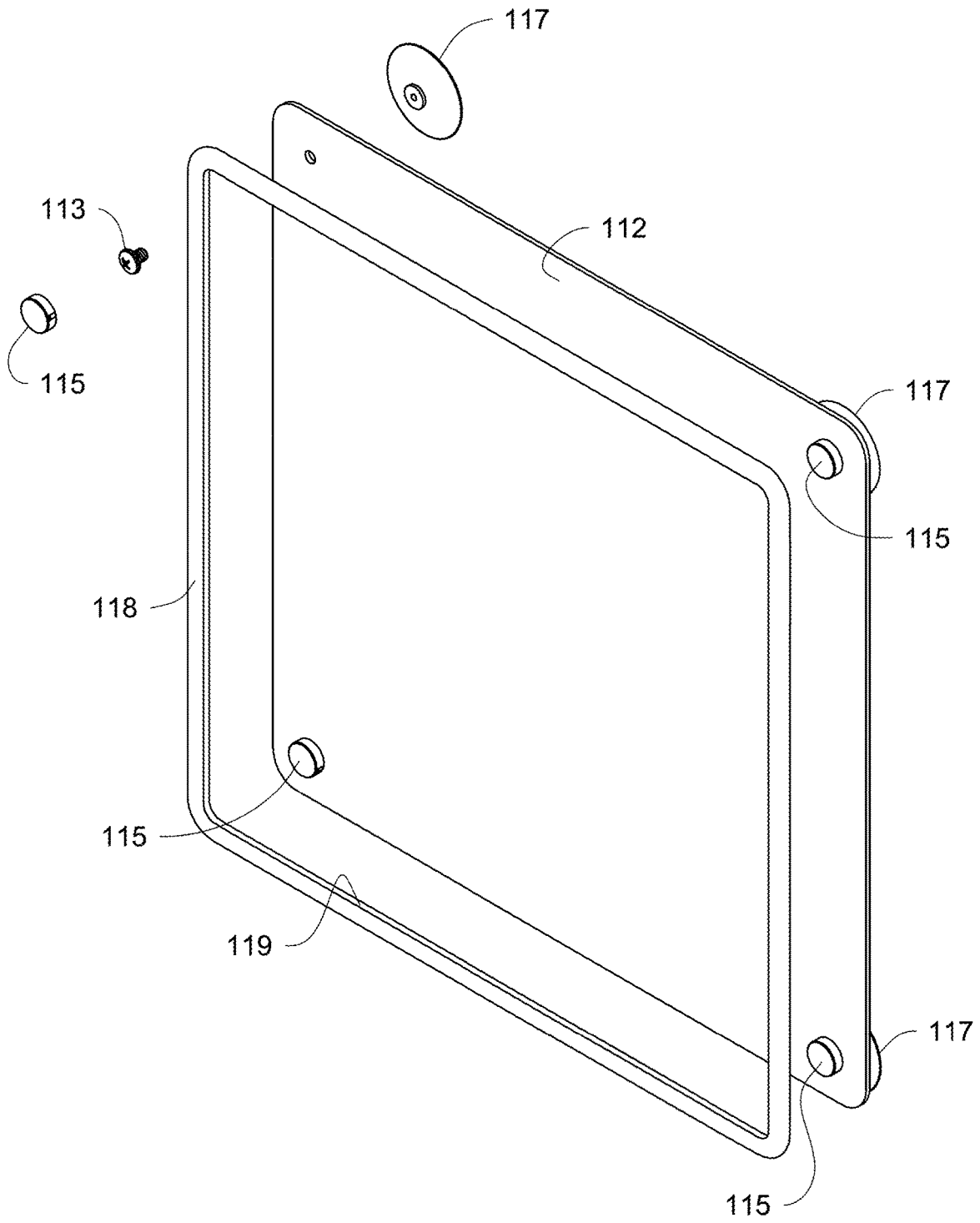
FIG. 20 depicts another embodiment with an edge protector that is attachable to the edges of the magnetic board.

FIG. 3C is a cross-sectional view of the magnetic board at one of the installation sections, according to another embodiment. As shown in FIG. 3C, a spacer 116 can be placed on the screw 113 and between the board and the wall 20 to allow drainage behind the board. According to yet another embodiment, the screw 113 can attach the board to a suction cup 117 that attaches to the wall. For example, the suction cup 117 can have a ½-inch base. In another embodiment depicted in FIG. 20, the magnetic board 112 (or the board 110) can include a soft, rubberized or plastic, water-resistant material surround 118 disposed around its perimeter edge to protect users from sharp/hard edges of the magnetic board 112. FIG. 20 depicts the surround 118 detached from the edges of the board 112 to depict the surround 118, but in use the surround 118 will be attached to the perimeter edge. The surround 118 can be attached to the magnetic board 112 is any suitable manner. For example, in one embodiment, the surround 118 can include a channel 119 that receives the edges of the board 118.

Figure 4:
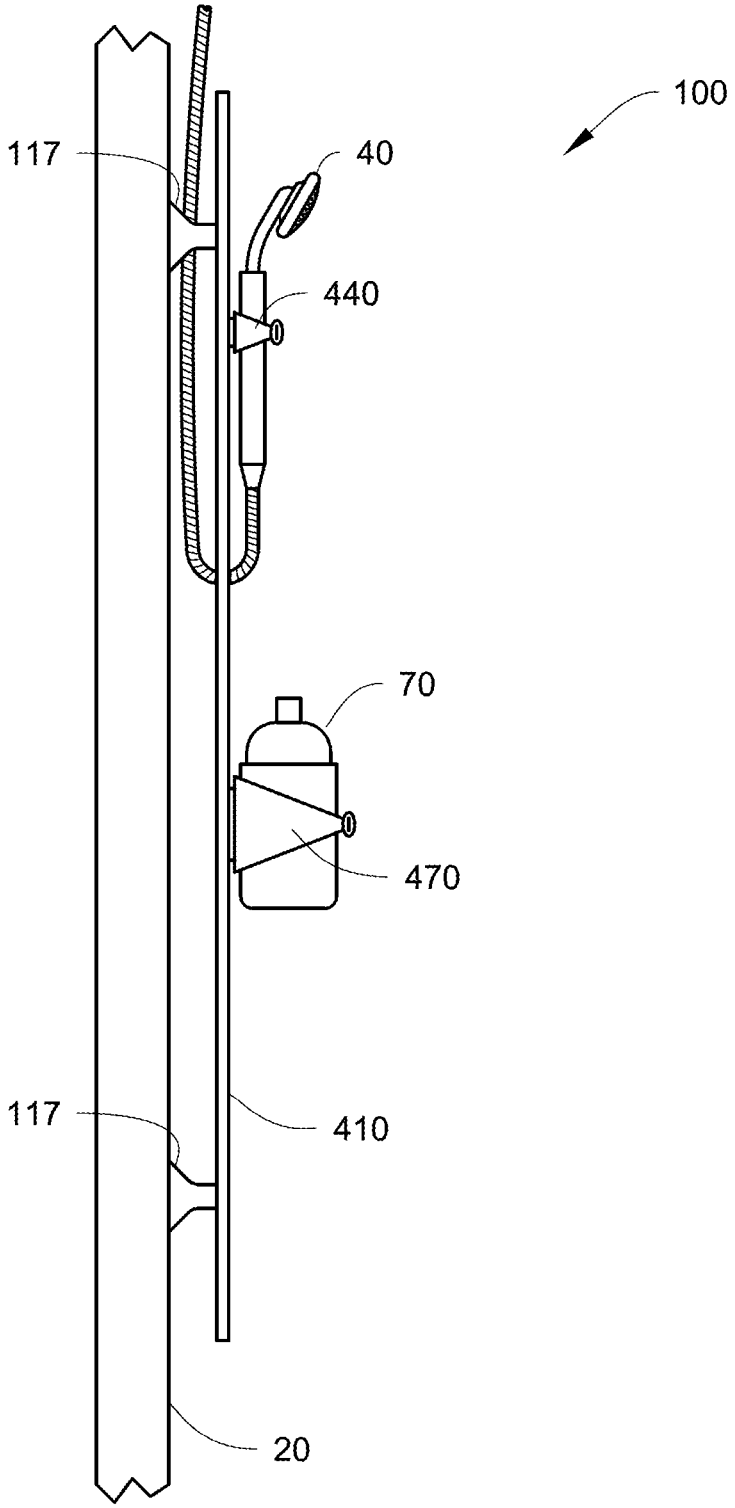
FIG. 4 is a side view of a mounting system, according to an embodiment.

FIG. 4 is a side view of a mounting system 100, according to an embodiment. As shown in FIG. 4, the system 100 includes a magnetic board 410 that is installed on a shower wall 20 using installation fasteners that include one or more suction cups 117. A first magnetic sleeve 440 and a second magnetic sleeve 470 are magnetically attached to the board 410. According to one embodiment, the magnetic board 410 and the magnetic sleeves 440 and 470 can be the board 110 and the magnetic sleeves 140 and 170 as shown and described in FIGS. 1 and 3. The first magnetic sleeve 440 is fastened or tightened over a handheld showerhead 40. The showerhead 40 connects to flexible plumbing and magnetically attaches to the board 410. Accordingly, a user can detach the showerhead 40 and reposition it to a different area of the magnetic board 410.

The first magnetic sleeve 440 wraps around the handle of the showerhead 40 and holds the showerhead 40 in an area of the magnetic board 410. According to an embodiment, the first magnetic sleeve 440 is configured to be an attachment that fits over the handle of the showerhead 40, so that a user with an existing showerhead can retrofit the first magnetic sleeve 440 onto the existing showerhead. Accordingly, the user can remove the first magnetic sleeve 440 and reuse is for mounting another showerhead or another shower item, such as a shampoo bottle. According to another embodiment, the first magnetic sleeve 440 is sized to fit the showerhead 40 particularly and attached permanently to the handle of the showerhead 40. Removing the first magnetic sleeve 440 can destroy or compromise the functionality or the aesthetic of the magnetic sleeve 440 or the showerhead 40. For example, the first magnetic sleeve 440 can be glued onto the showerhead 40 by the manufacturer or by the user, instead of tightened onto the showerhead 40 by an adjustable fastener.

Figure 5:
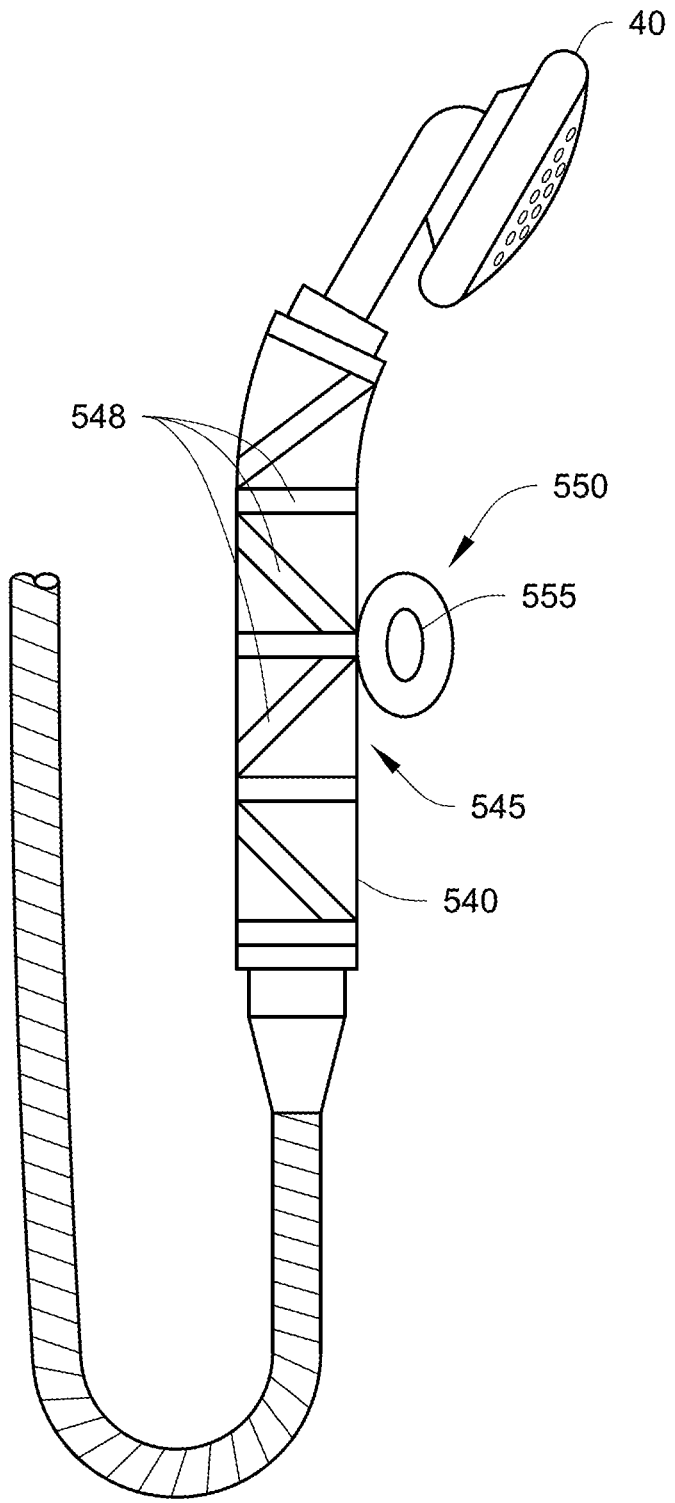
FIG. 5 is a side view of a showerhead sleeve, according to an embodiment.

FIG. 5 is a side view of a showerhead sleeve 540, according to an embodiment. Alternatively, the showerhead sleeve 540 can be referred to as a magnetic sleeve 540. According to one embodiment, the magnetic sleeve 540 can be the first or second magnetic sleeves 140 or 170 as shown and described in FIG. 1, or the first magnetic sleeve 440 as shown and described in FIG. 4. As shown in FIG. 5, the magnetic sleeve 540 wraps around the handle of the showerhead 40. The magnetic sleeve 540 includes a tubular section 545 and an adjustable fastener 550. When the adjustable fastener 550 is tightened, the tubular section 545 wraps around the showerhead 40 and the sleeve 540 includes magnets to securely hold the showerhead 40 on the magnetic board, such as the board 110 of FIG. 1 or the magnetic tiles 120 of FIG. 2. The tubular section 545 can be made partially from one or more pieces of grip material. The tubular section 545 can further include one or more magnetic pieces encapsulated or contained by the grip material. The magnetic pieces can be magnets or ferrous metals so that the magnetic pieces can attach the magnetic sleeve 540 to the magnetic board 110 or the magnetic tiles 120 as shown and described in FIGS. 1 and 2. The grip material can be a water resistant material, an elastomer, or a fabric so that water will unlikely penetrate the grip material and corrode the magnetic pieces or accumulate in the magnetic sleeve 540 facilitating microbial growth. The grip material can include a non-slip coating or textures so that the showerhead 40 with the magnetic sleeve 540 wrapped around is less slippery. Magnetic pieces can be alternatively referred to magnetic inserts.

The adjustable fastener 550 can tighten and loosen around the showerhead 40 circumferentially such that the magnetic sleeve 540 can be fixed to or released from the showerhead 40. The adjustable fastener 550 can include a tension portion 548 and a control portion 555. The tension portion 548 can include one or more laces, zip-ties, wires, or cables that wrap around the showerhead 40 or the tubular section 545. The tension portion 548 connects to and is controlled by the control portion 555. The control portion 555 can be a dial. A segment of the tension portion 548 can be wrapped around a core attached to the dial that is turned or rotated by the dial. To wrap a larger segment of the tension portion 548 around the core, the dial is turned in one direction causing the tension portion 548 to be wrapped more tightly around the showerhead 40. To release the magnetic sleeve 540 from the showerhead 40, the dial is turned in an opposite direction in order to unwrap some of the tension portion 548 from the core causing the tension to be loosened over the showerhead 40. According to one embodiment, the adjustable fastener 550 with a dial can be a reel-based lacing system, such as a$^{BOA}$® system by BOA Technology, Inc. According to another embodiment, the magnetic sleeve 540 can be a component used in the system 100 as shown and described in FIG. 1.

Figure 6:
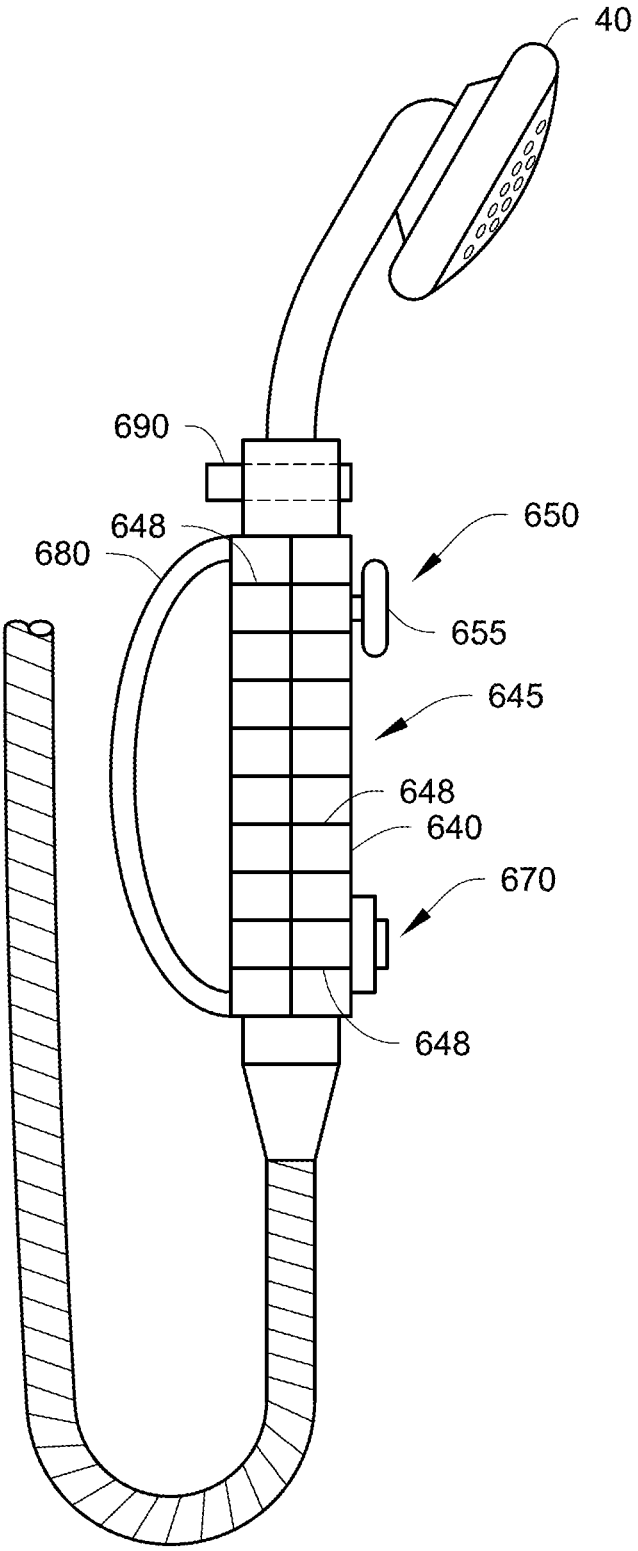
FIG. 6 is a side view of a showerhead sleeve, according to another embodiment.

FIG. 6 is a side view of a showerhead sleeve 640, according to another embodiment. Alternatively, the showerhead sleeve 640 can be referred to as a magnetic sleeve 640. According to one embodiment, the magnetic sleeve 640 can be the first or second magnetic sleeves 140 or 170 as shown and described in FIG. 1, or the first magnetic sleeve 440 as shown and described in FIG. 4. As shown in FIG. 6, the magnetic sleeve 640 wraps around the handle of the showerhead 40. The magnetic sleeve 640 includes a tubular section 645 and an adjustable fastener 650. When the adjustable fastener 550 is tightened, the tubular section 645 wraps around the showerhead 40 and securely holds the showerhead 40 on the magnetic board, such as the board 110 of FIG. 1 or the magnetic tiles 120 of FIG. 2. The tubular section 645 can be made partially from one or more pieces of grip material. The tubular section 645 can further include one or more magnetic pieces encapsulated or contained by the grip material. The magnetic pieces can be magnets or ferrous metals so that the magnetic pieces can attach the magnetic sleeve 640 to the magnetic board 110 or the magnetic tiles 120 as shown and described in FIGS. 1 and 2. The grip material can be a water resistant material, an elastomer, or a fabric so that water will unlikely penetrate the grip material and corrode the magnetic pieces or accumulate in the magnetic sleeve 640 facilitating microbial growth. The grip material can include a non-slip coating or textures so that the showerhead 40 with the magnetic sleeve 640 wrapped around is less slippery.

The adjustable fastener 650 can tighten and loosen around the handle of the showerhead 40 circumferentially such that the magnetic sleeve 640 can be fixed to or released from the showerhead 40. The adjustable fastener 650 can include a tension portion 648 and a control portion 655. The tension portion 648 can include one or more laces, wires, or cables that wrap around the showerhead 40 or the tubular section 645. The tension portion 648 connects to and is controlled by the control portion 655. The control portion 655 can be a clip or a clamp that restricts the tension portion 648 from loosening, for example, by pinching the tension portion 648. The clip or clamp can be actuated by a spring, such as a coil spring. According to one embodiment, the adjustable fastener 650 can be a ripcord type system. A larger segment of the tension portion 648 can be pulled through the control portion 655 in order to tighten the magnetic sleeve 640 around the showerhead 40. The clip or the clamp of the control portion 655 can be opened to release tension portion 648 and loosen the magnetic sleeve 640 from the showerhead 40.

According to another embodiment, the magnetic sleeve 640 can be a component used in the system 100 as shown and described in FIG. 1. It is appreciated that the magnetic sleeves 540 and 640 are shown to hold or be part of the showerhead 40 in FIGS. 5 and 6. The magnetic sleeves 540 and 640 are not limited to wrapping around handles of showerheads. The magnetic sleeves 540 and 640 can be used over other elongated shower items, such as bottles of personal hygiene products, handles of a long handle sponge, or the like. According to yet another embodiment, the magnetic sleeve 640 can attach to a grasping cuff 680 for the user to comfortably and securely hold the shower item, such as a showerhead 40, a bottle, or the like. According to yet another embodiment, the magnetic sleeve 640 can include an alert button 670 that calls emergency services with the push of the button. According to yet another embodiment, a switch 690 can be included into the shower item, such as the showerhead 40. The switch 690 can be pushed to an on position or an off position to control the flow of the water from the showerhead 40. According to yet another embodiment, the switch 690 can be integrated into the magnetic sleeve 640 portion of the showerhead 40.

Figure 7:
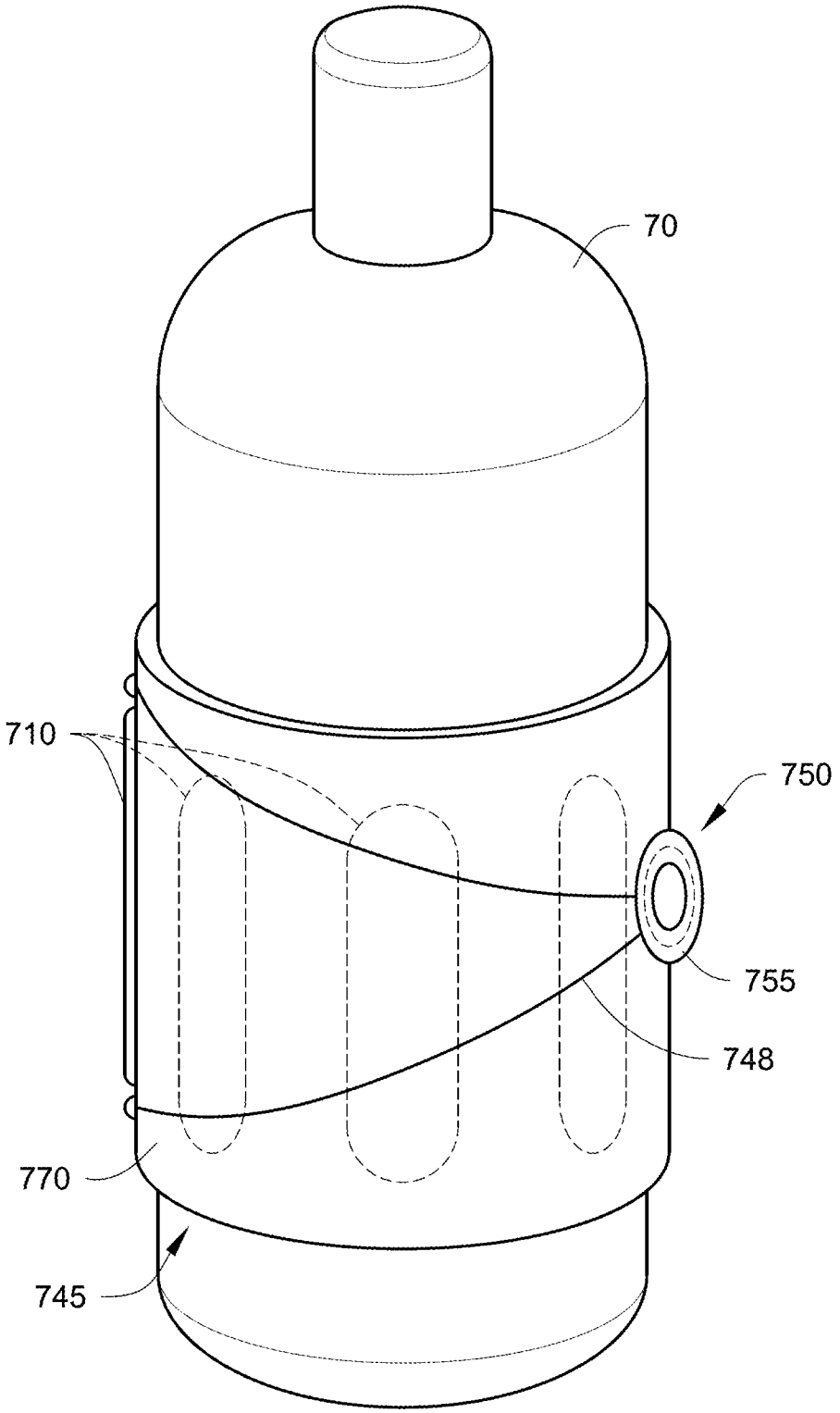
FIG. 7 is a perspective view of a bottle sleeve, according to an embodiment.

FIG. 7 is a perspective view of a bottle sleeve 770, according to an embodiment. Alternatively, the bottle sleeve 770 can be referred to as a magnetic sleeve 770. According to one embodiment, the magnetic sleeve 770 can be the first or second magnetic sleeves 140 or 170 as shown and described in FIG. 1. As shown in FIG. 7, the magnetic sleeve 770 wraps around a bottle 70. The bottle 70 can be a bottle containing personal hygiene material such as shampoo, soap, and the like. The magnetic sleeve 770 includes a tubular section 745 with an opened top and an opened bottom, and an adjustable fastener 750 wrapped around.

According to one embodiment, the bottle 70 can protrude out of the magnetic sleeve 770 from the opened top and/or the opened bottom. When the adjustable fastener 750 is tightened, the tubular section 745 wraps around the bottle 70 and securely holds the bottle on the magnetic board, such as the board 110 of FIG. 1 or the magnetic tiles 120 of FIG. 2. The tubular section 745 can be made from one or more pieces of grip material. The tubular section 745 can further include one or more magnetic pieces 710 encapsulated or contained by the grip material. The magnetic pieces 710 can be magnets or ferrous metals so that the magnetic pieces 710 can attach the magnetic sleeve 740 to the magnetic board 110 or the magnetic tiles 120 as shown and described in FIGS. 1 and 2. According to another embodiment, the magnetic pieces 710 can be contained in one or more pockets in the grip material or sewed onto the grip material. The grip material can be a water resistant material, an elastomer, or a fabric so that water will unlikely penetrate the grip material and corrode the magnetic pieces 710 or accumulate in the magnetic sleeve 740 facilitating microbial growth. The grip material can include a non-slip coating or textures so that the bottle 70 with the magnetic sleeve 740 wrapped around is less slippery.

The adjustable fastener 750 can tighten and loosen around the bottle 70 in a circumferential direction such that the magnetic sleeve 740 can be fixed to or released from the bottle 70. The adjustable fastener 750 can include a tension portion 748 and a control portion 755. The tension portion 748 can include one or more laces, wires, or cables that wrap around the bottle 70 or the tubular section 745. The tension portion 748 connects to and is controlled by the control portion 755. The control portion 755 can be a dial. A segment of the tension portion 748 can be wrapped around a core that is turned or rotated by the dial. To wrap a larger segment of the tension portion 748 around the core, the dial is turned in one direction causing the tension portion 748 to be wrapped more tightly around the bottle 70. To release the magnetic sleeve from the bottle 70, the dial is turned in an opposite direction in order to loosen some of the tension portion 748 from the core and loosen the tension around the bottle. According to one embodiment, the adjustable fastener 750 can be a reel based lacing system, such as a BOA type system by BOA Technology, Inc. According to another embodiment, the magnetic sleeve 740 can be a component used in the system 100 as shown and described in FIG. 1.

Figure 8:
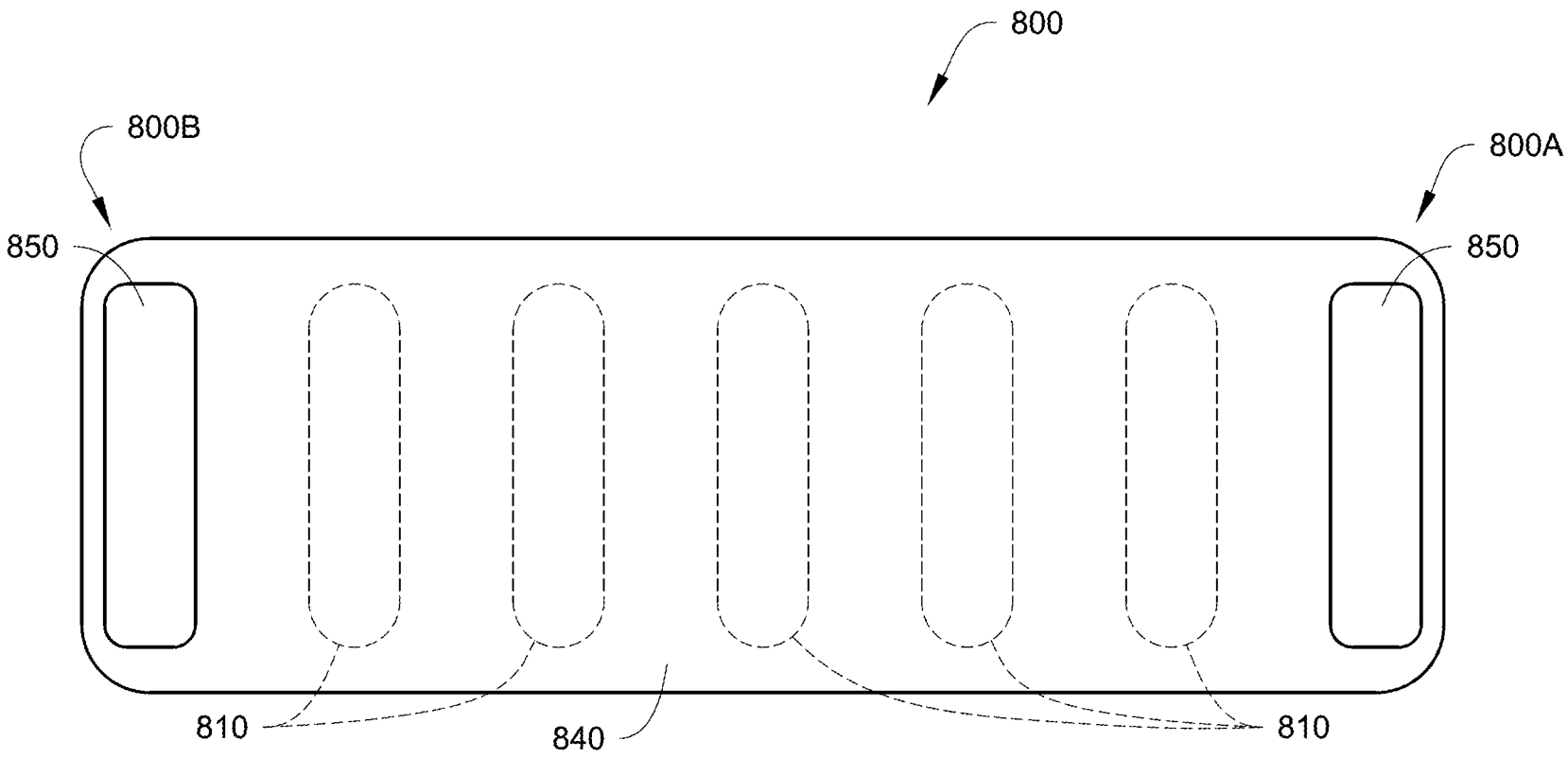
FIG. 8 is a schematic view of a bottle sleeve, according to another embodiment.

FIG. 8 is a schematic view of a bottle sleeve 800, according to another embodiment. Alternatively, the bottle sleeve 800 can be referred to as a magnetic sleeve 800. According to one embodiment, the magnetic sleeve 800 can be the first or second magnetic sleeves 140 or 170 as shown and described in FIG. 1. As shown in FIG. 8, the magnetic sleeve 800 is an elongated structure includes a sleeve member 840, one or more magnetic pieces 810, and an adjustable fastener 850. The magnetic sleeve 800 can wrap around a shower item, such as a bottle, a handle, a showerhead, or the like. The magnetic sleeve 800 can have a rectangular, a rounded rectangular, an elongated oval shape, or the like. The magnetic sleeve 800 can have a first end 800A and a second end 800B opposite from the first end 800A. The adjustable fastener 850 has at least two portions that latches on each other forming a loop, or a tubular section, and secure the magnetic sleeve 800 onto the shower item. According to one embodiment, at least one portion of the adjustable fastener 850 is located near each of the first end 800A and the second end 800B. The magnetic sleeve member 840 can be made from one or more pieces of grip material. The magnetic sleeve member 840 can further include one or more magnetic pieces 810 encapsulated or contained by the grip material. The magnetic pieces 810 can be magnets or ferrous metals so that the magnetic pieces 810 can attach the magnetic sleeve 800 to the magnetic board 110 or the magnetic tiles 120 as shown and described in FIGS. 1 and 2. According to another embodiment, the magnetic pieces 810 can be contained in one or more pockets in the grip material or sewed onto the grip material. According to one embodiment, the magnetic pieces 810 are evenly distributed between the first end 800A and the second end 800B. Each of the magnetic pieces 810 can have an elongated shape with a narrower dimension along the direction between the first end 800A and the second end 800B and a wider dimension perpendicular to the direction between the first end 800A and the second end 800B. The grip material can be a water resistant material, an elastomer, or a fabric so that water will unlikely penetrate the grip material and corrode the magnetic pieces 810 or accumulate in the magnetic sleeve 800 facilitating microbial growth. The grip material can include a non-slip coating or textures so that the shower item wrapped with the magnetic sleeve 800 is less slippery.

The adjustable fastener 850 attaches the magnetic sleeve 800 to a shower item (not shown). The magnetic sleeve member 840 of the magnetic sleeve 800 can be a flexible material so that the magnetic sleeve 800 can wrap around a shower item. The portions of the adjustable fasteners 850 then attaches to each other folding the magnetic sleeve 800 into a tubular shape around the shower item. The portion of the adjustable fasteners 850 can be attached with a partial offset according to the size of the shower item. The adjustable fastener 850 can be a pair of hook and loop type fasteners. According to another embodiment, the magnetic sleeve 800 can be a component used in the system 100 as shown and described in FIG. 1.

Figure 9:
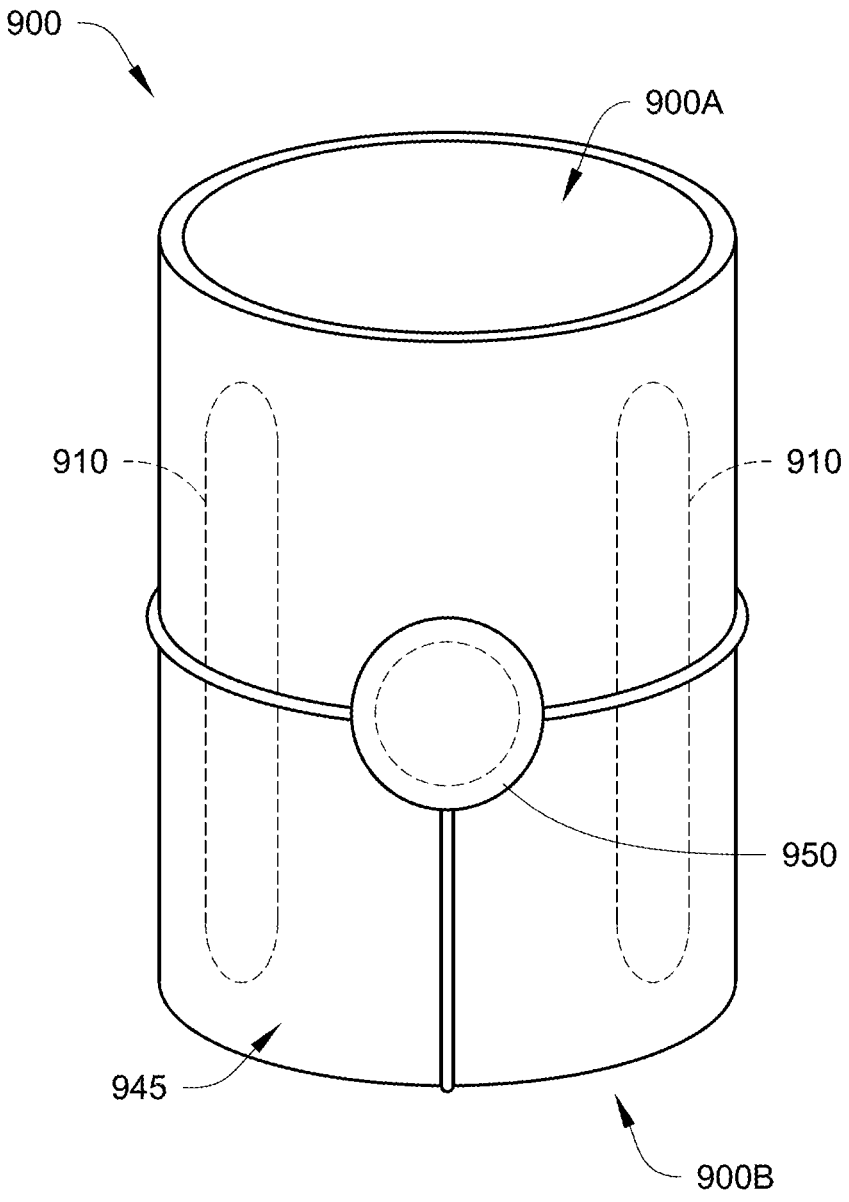
FIG. 9 is a perspective view of a bottle sleeve, according to another embodiment.

FIG. 9 is a perspective view of a bottle sleeve 900, according to another embodiment. Alternatively, the bottle sleeve 900 can be referred to as a magnetic sleeve 900. According to one embodiment, the magnetic sleeve 900 can be the first or second magnetic sleeves 140 or 170 as shown and described in FIG. 1. As shown in FIG. 9, the magnetic sleeve 900 is a tubular structure that includes a tubular section 945, one or more magnetic pieces 910, and an adjustable fastener 950. According to one embodiment, the tubular section 945, the one or more magnetic pieces 910, and the adjustable fastener 950 can be the tubular section 745, the one or more magnetic pieces 710, and the adjustable fastener 750, respectively, as shown and described in FIG. 7. The magnetic sleeve 900 can include a top end 900A and a bottom end 900B. According to one embodiment, the top end 900A can be an opened end to receive a shower item, such as a bottle. The bottom end 900B can be an opened end as well to allow a shower item, such as a bottle, to protrude from the bottom end 900B of the magnetic sleeve 900. According to anther embodiment, the bottom end 900B can be closed and can include a perforated bottom (shown in FIG. 13) that allows water to drain from the magnetic sleeve 900.

Figure 10:
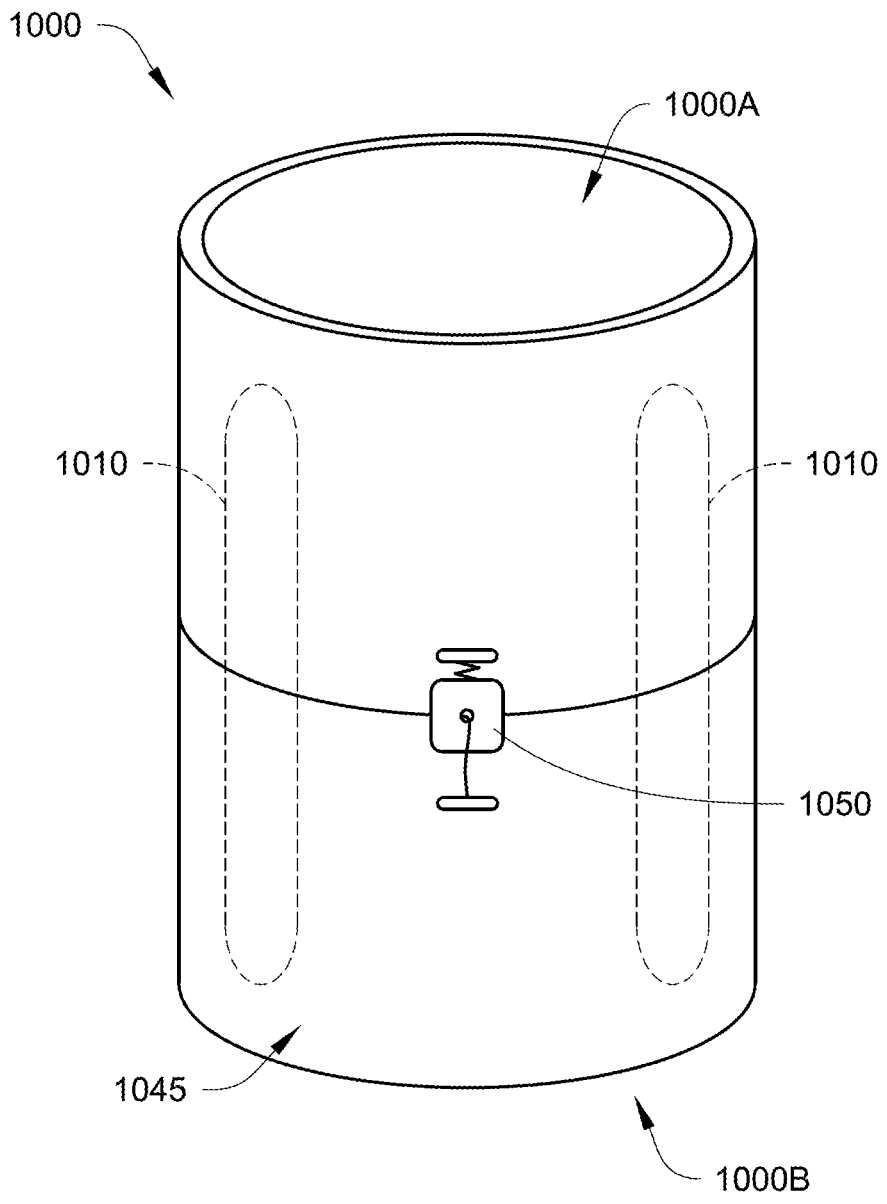
FIG. 10 is a perspective view of a bottle sleeve, according to yet another embodiment.

FIG. 10 is a perspective view of a bottle sleeve 1000, according to yet another embodiment. Alternatively, the bottle sleeve 1000 can be referred to as a magnetic sleeve 1000. According to one embodiment, the magnetic sleeve 1000 can be the first or second magnetic sleeves 140 or 170 as shown and described in FIG. 1. As shown in FIG. 10, the magnetic sleeve 1000 is a tubular structure that includes a tubular section 1045, one or more magnetic pieces 1010, and an adjustable fastener 1050. According to one embodiment, the tubular section 1045, the one or more magnetic pieces 1010, and the adjustable fastener 1050 can be the tubular section 745, the one or more magnetic pieces 710, and the adjustable fastener 650, respectively, as shown and described in FIGS. 6 and 7. The magnetic sleeve 1000 can include a top end 1000A and a bottom end 1000B. According to one embodiment, the top end 1000A can be an opened end to receive a shower item, such as a bottle. The bottom end 1000B can be an opened end as well to allow a shower item, such as a bottle, to protrude from the bottom end 1000B of the magnetic sleeve 1000. According to anther embodiment, the bottom end 1000B can be closed and can include a perforated bottom (shown in FIG. 13) that allows water to drain from the magnetic sleeve 1000.

Figure 11:
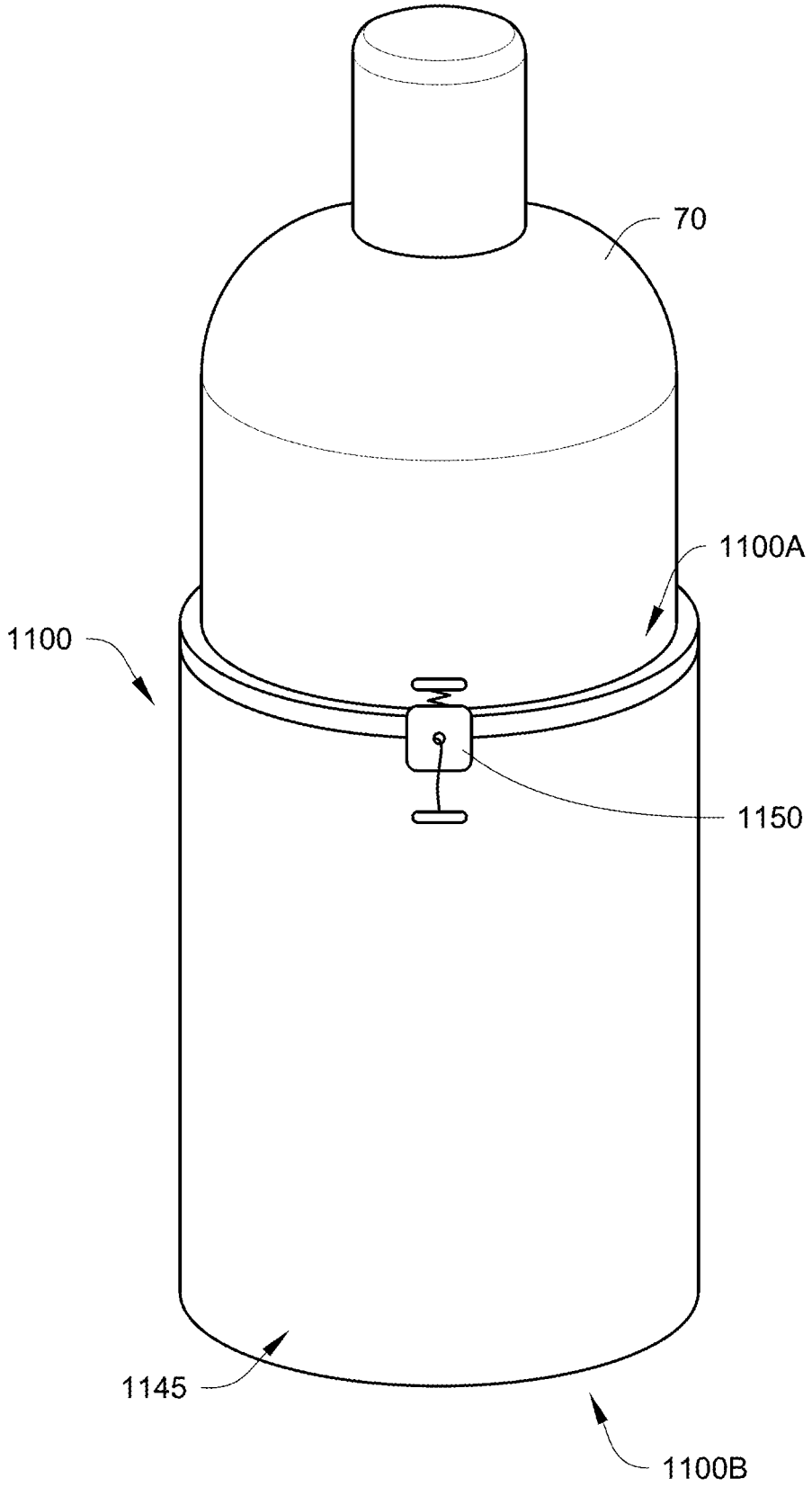
FIG. 11 is a perspective view of a bottle sleeve, according to yet another embodiment.

FIG. 11 is a perspective view of a bottle sleeve 1100, according to yet another embodiment. Alternatively, the bottle sleeve 1100 can be referred to as a magnetic sleeve 1100. According to one embodiment, the magnetic sleeve 1100 can be the first or second magnetic sleeves 140 or 170 as shown and described in FIG. 1. As shown in FIG. 11, the magnetic sleeve 1100 is a tubular structure that includes a tubular section 1145, and an adjustable fastener 1150. The magnetic sleeve 1100 can further include one or more magnetic pieces (not shown) embedded into the tubular section 1145. According to one embodiment, the tubular section 1145, the one or more magnetic pieces, and the adjustable fastener 1150 can be the tubular section 745, the one or more magnetic pieces 710, and the adjustable fastener 650, respectively, as shown and described in FIGS. 6 and 7. The magnetic sleeve 1100 can include a top end 1100A and a bottom end 1100B. According to one embodiment, the top end 1100A can be an opened end to receive a shower item, such as a bottle. The bottom end 1100B can be an opened end as well to allow a shower item, such as a bottle, to protrude from the bottom end 1100B of the magnetic sleeve 1100. According to anther embodiment, the bottom end 1100B can include a perforated bottom (shown in FIG. 13) that allows water to drain from the magnetic sleeve 1100. According to yet another embodiment, the bottom end 1100B can include a cap that is attached to the tubular section 1145 and partially closes the bottom end 1100B. The cap can be made using the same material of the tubular section 1145. The tubular section 1145 and the cap can be made from a foam material. According to an embodiment, the tubular section 1145 and the cap can be a magnetic foam sleeve forming what may be referred to as a magnetic koozie. According to yet another embodiment, the adjustable fastener 1150 is positioned near or at the top end 1100A. According to yet another embodiment, the adjustable fastener 1150 can be a hook and loop type fastener. According to yet another embodiment where the bottom end 1100B is partially closed or completely closed, the adjustable fastener 1150 can be omitted.

Figure 12:
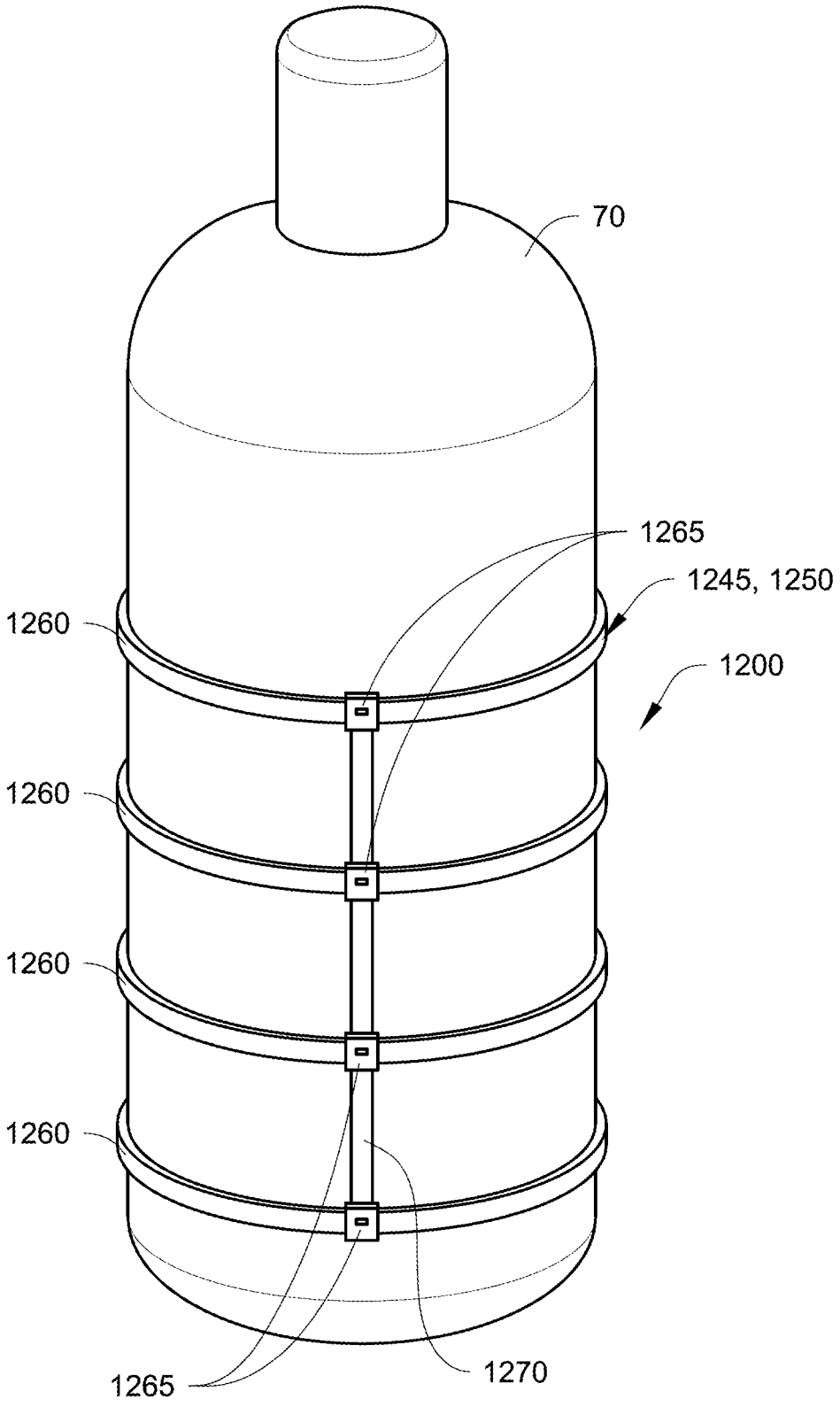
FIG. 12 is a perspective view of a bottle sleeve, according to yet another embodiment.

FIG. 12 is a perspective view of a bottle sleeve 1200, according to yet another embodiment. Alternatively, the bottle sleeve 1200 can be referred to as a magnetic sleeve 1200. According to one embodiment, the magnetic sleeve 1200 can be the first or second magnetic sleeves 140 or 170 as shown and described in FIG. 1. The magnetic sleeve 1200 can include a tubular section 1245 and an adjustable fastener 1250 created from a set of zip-ties 1260. According to one embodiment, the set of zip-ties 1260 can be made from a non-magnetic material. Magnetic materials can be added to the zip-ties 1260. According to another embodiment, the zip-ties 1260 can be made from a magnetic material that attracts to or is attracted to the board 110 or the magnetic tiles 120 as shown and described in FIGS. 1 and 2. Each of the zip-ties 1260 includes a flexible tape with an integrated gear track and a ratchet end 1265. When installing over a shower item, such as a bottle 70, the flexible tape of the zip-tie 1260 wraps around the shower item and inserts into the ratchet end 1265 forming a loop around the shower item. The ratchet end 1265 locks onto the integrated gear track and allows the loop to become tighter. The loop of the zip-tie 1260 is then tightened until the zip-tie 1260 is attached to the shower item. One or more attached zip-ties 1260 can be used to form the magnetic sleeve 1200 that holds the shower item, such as a bottle 70, onto the magnetic board 110 or the magnetic tiles 120 as shown and described in FIGS. 1 and 2. According to another embodiment, a bar 1270 attaches each of the zip-ties 1165 at the ratchets 1165 along the direction extending along the longitudinal direction of the shower item being held within the magnetic sleeve 1200.

Figure 13:
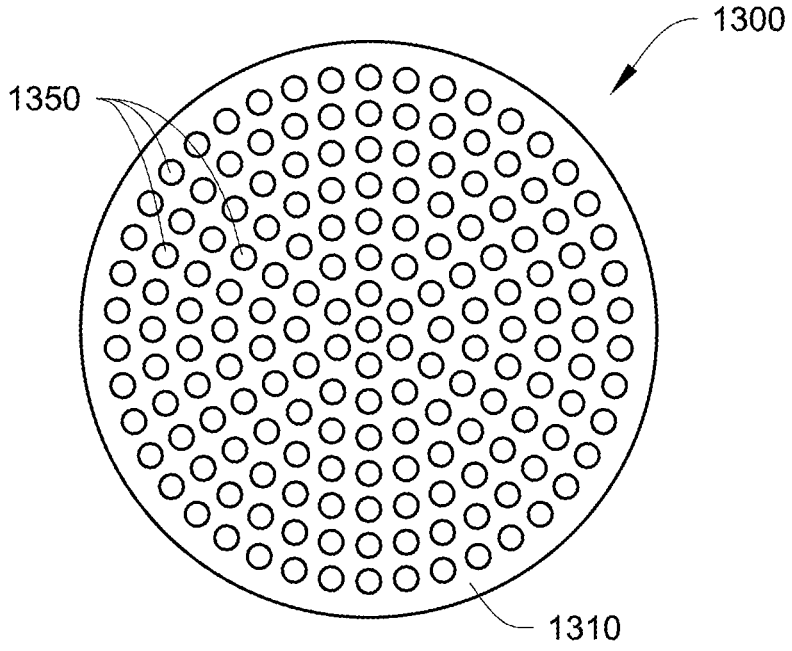
FIG. 13 is a schematic view of a perforated bottom of the bottle sleeve, according to an embodiment.

FIG. 13 is a schematic view of a perforated bottom 1200 of a bottle sleeve, according to an embodiment. As shown in FIG. 13, the perforated bottom 1200 includes a base material 1310 and any number of perforations 1350. The perforated bottom 1200 attaches to or forms a bottom end of a magnetic sleeve, such as the bottom end 900B of the magnetic sleeves 900 as shown and described in FIG. 9, and the bottom end 1000B of the magnetic sleeve 1000 as shown and described in FIG. 10. The perforated bottom 1200 holds the shower item within the magnetic sleeve and allows water to drain.

Figure 14:
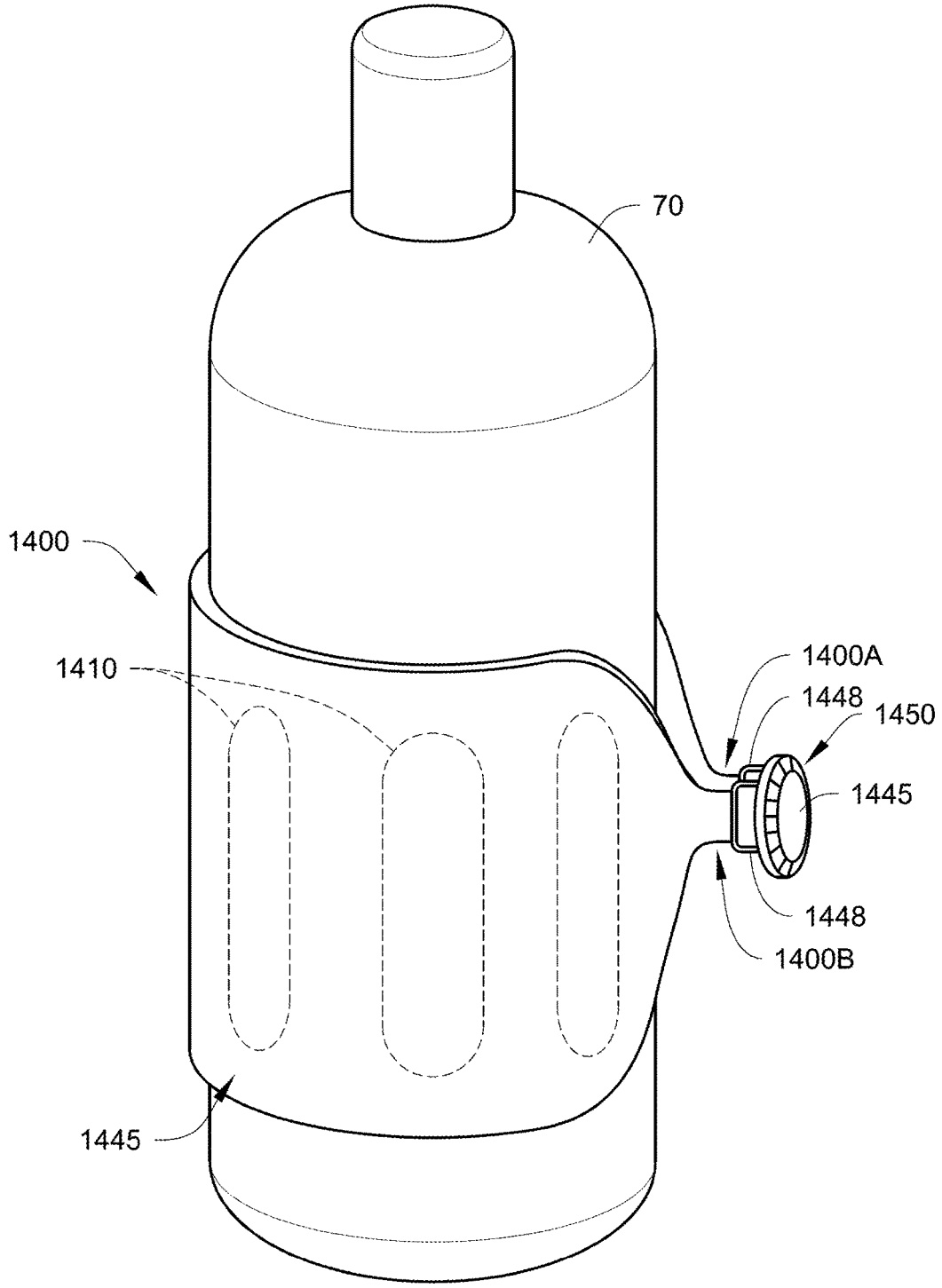
FIG. 14 is a perspective view of a bottle sleeve, according to yet another embodiment.

FIG. 14 is a perspective view of a bottle sleeve 1400, according to yet another embodiment. Alternatively, the bottle sleeve 1400 can be referred to as a magnetic sleeve 1400. According to one embodiment, the magnetic sleeve 1400 can be the first or second magnetic sleeves 140 or 170 as shown and described in FIG. 1. As shown in FIG. 14, the magnetic sleeve 1400 is a tubular structure that includes a tubular section 1445, one or more magnetic pieces 1410, and an adjustable fastener 1450 attached to a first end 1400A and a second end 1400B of the magnetic sleeve 1400. According to one embodiment, the tubular section 1445, the one or more magnetic pieces 1410, the first end 1400A, and the second end 1400B can be the tubular section 840, the one or more magnetic pieces 810, the first end 800A, and the second end 800B respectively, as shown and described in FIG. 8.

As shown in FIG. 14, the magnetic sleeve 1400 is wrapped around a shower item, such as a bottle 70, and tightened by an adjustable fastener 1450. The adjustable fastener 1450 can include a tension portion 1448 and a control portion 1455. The tension portion 1448 can include one or more laces, wires, or cables that pull on the first end 1400A and the second end 1400B and tightening the magnetic sleeve 1400 around the shower item, such as a bottle or a showerhead. The tension portion 1448 connects to and is controlled by the control portion 1455. The control portion 1455 can be a dial. A segment of the tension portion 1448 can be wrapped around a core attached to the dial that is turned or rotated by the dial. To wrap a larger segment of the tension portion 1448 around the core, the dial 1455 is turned in one direction causing the tension portion 1448 to be wrapped more tightly around the bottle 70. To release the magnetic sleeve 1400 from the bottle 70, the dial 1455 is turned in an opposite direction in order to unwrap some of the tension portion 1448 from the core and loosen the tension over the bottle 70. According to one embodiment, the adjustable fastener 1455 can be a reel based lacing system, such as a BOA type system by BOA Technology, Inc.

Figure 15:
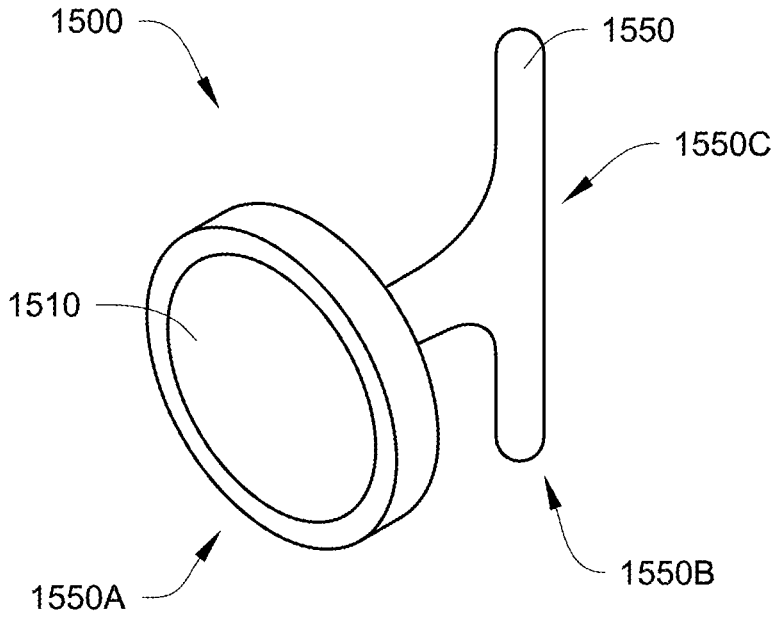
FIG. 15 is a perspective view of a bottle medallion, according to one embodiment.

FIG. 15 is a perspective view of a bottle medallion 1500, according to one embodiment. The bottle medallion 1500 is configured to be a single use piece that is attached to a shower item, such as a bottle or a showerhead, using an adhesive. After attaching the medallion 1500 on the shower item, the medallion 1500 can magnetically mount the shower item onto the board 110 or the magnetic tiles 120 as shown and described in FIGS. 1 and 2. As shown in FIG. 15, the bottle medallion 1500 includes a magnetic piece 1510 and a base 1550. The magnetic piece 1510 can be a magnet or a ferrous metal that magnetically attracts to or be attracted to the board 110 or the magnetic tiles 120 of FIG. 1 or 2. The base 1550 includes a magnetic mounting end 1550A, a shower item mounting end 1550B, and an adhesive 1550C. The base 1550 is affixed the magnetic piece 1510 to the shower item using the adhesive 1550C.

Figure 16:
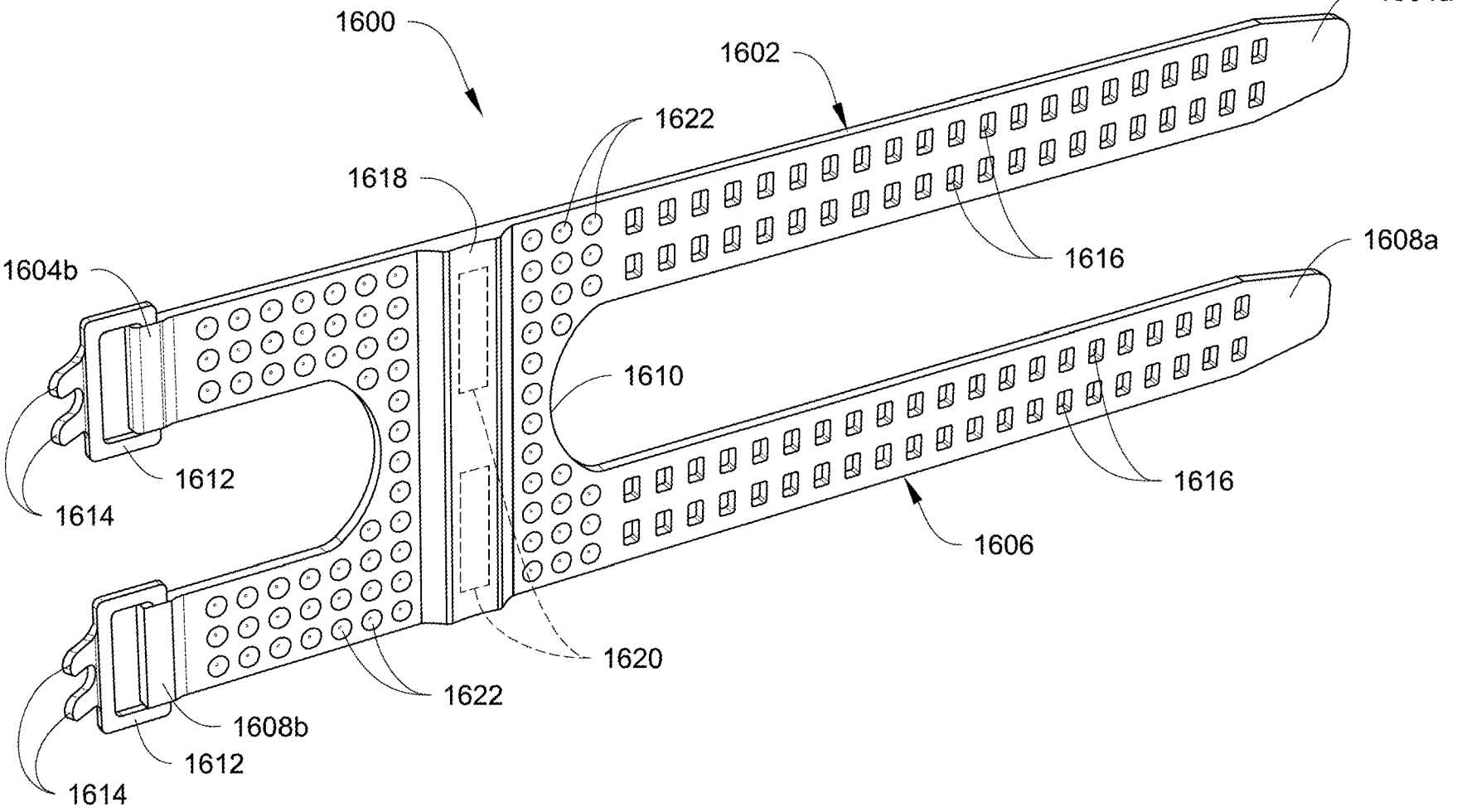
FIG. 16 depicts another form of a bottle sleeve configured with a buckle for securing a sleeve around a bottle.

FIG. 16 illustrates another example of a magnetic sleeve or wrap 1600 that can be secured around a shower item, such as a bottle, for magnetically securing the shower item. The sleeve 1600 is an H shaped structure with a first leg 1602 having opposite ends 1604*a*, 1604*b*, a second leg 1606 having opposite ends 1608*a*, 1608*b*, and a central connector 1610 connecting the legs 1602, 1606. The ends 1604*b*, 1608*b* include buckles 1612 with one or more prongs 1614. Between the central portion 1610 and the ends 1604*a*, 1608*a*, the legs 1602, 1606 are formed with openings 1616 for receiving the prongs 1614. The central connector 1610 can include a thickened section 1618 on the outer facing surface thereof that is thicker than the rest of the sleeve 1600. One or more magnets 1620 (shown in broken lines) are embedded within the thickened section 1618. The sleeve 1600 can be formed of a polymeric or rubber material, such as polyurethane, and the buckles 1612 can formed of any suitable water resistant grip material with a slip-resistant texture such as plastic or metal. In addition, the openings 1616 help provide a slip-resistant texture. In addition, the outer surface of the sleeve 1600 can be provided with dimples 1622 to help gripping of the sleeve 1600. In operation, the sleeve 1600 wraps around the shower item, with the legs 1602, 1606, openings 1616 and the buckles 1612 being used to adjust and secure the sleeve 1600 around the shower item. Once the sleeve 1600 is secured around the item, the magnets 1620 serve to magnetically secure the sleeve 1600 and thus the item wrapped by the sleeve 1600 to the shower wall as described above.

Figure 17:
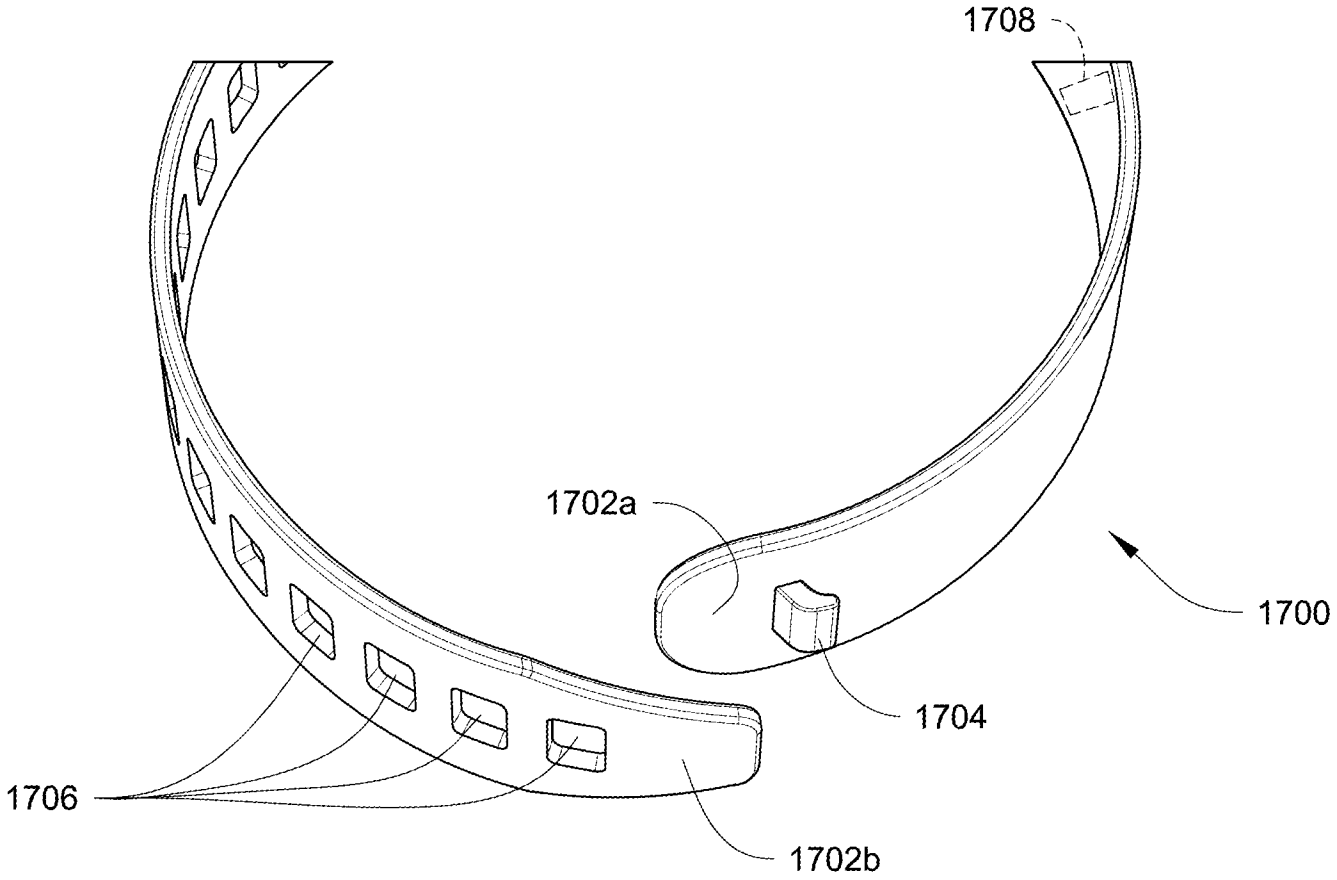
FIG. 17 depicts another form of a bottle sleeve configured with a hook for securing the sleeve around a bottle.

FIG. 17 illustrates a portion of another example of a magnetic sleeve or wrap 1700 that can be secured around a shower item, such as a bottle, for magnetically securing the shower item. The sleeve 1700 forms a strap or band that wraps around the item and has first and second ends 1702*a*, 1702*b*. The end 1702*a* is provided with one or more hooks 1704. In addition, between the hook(s) 1704 and the end 1702*b*, the strap includes a plurality of longitudinally spaced holes 1706 formed therethrough that are sized to receive the hook(s) 1704. In addition, one or more magnets 1708 (shown in broken lines) are embedded within the strap. The sleeve 1700 can be formed of any suitable water resistant grip material with a slip-resistant texture such as a polymeric or rubber material, such as polyurethane. In addition, the holes 1706 help provide a slip-resistant texture. In operation, the sleeve 1700 wraps around the shower item, with the hook(s) 1704 and the holes 1706 being used to adjust and secure the sleeve 1700 around the shower item. Once the sleeve 1700 is secured around the item, the magnet(s) 1708 serve to magnetically secure the sleeve 1700 and thus the item wrapped by the sleeve 1700 to the shower wall as described above. The hook(s) 1704 may be reinforced with a metallic insert that is surrounded by the polymeric or rubber material forming the hook(s) 1704.

Figure 18:
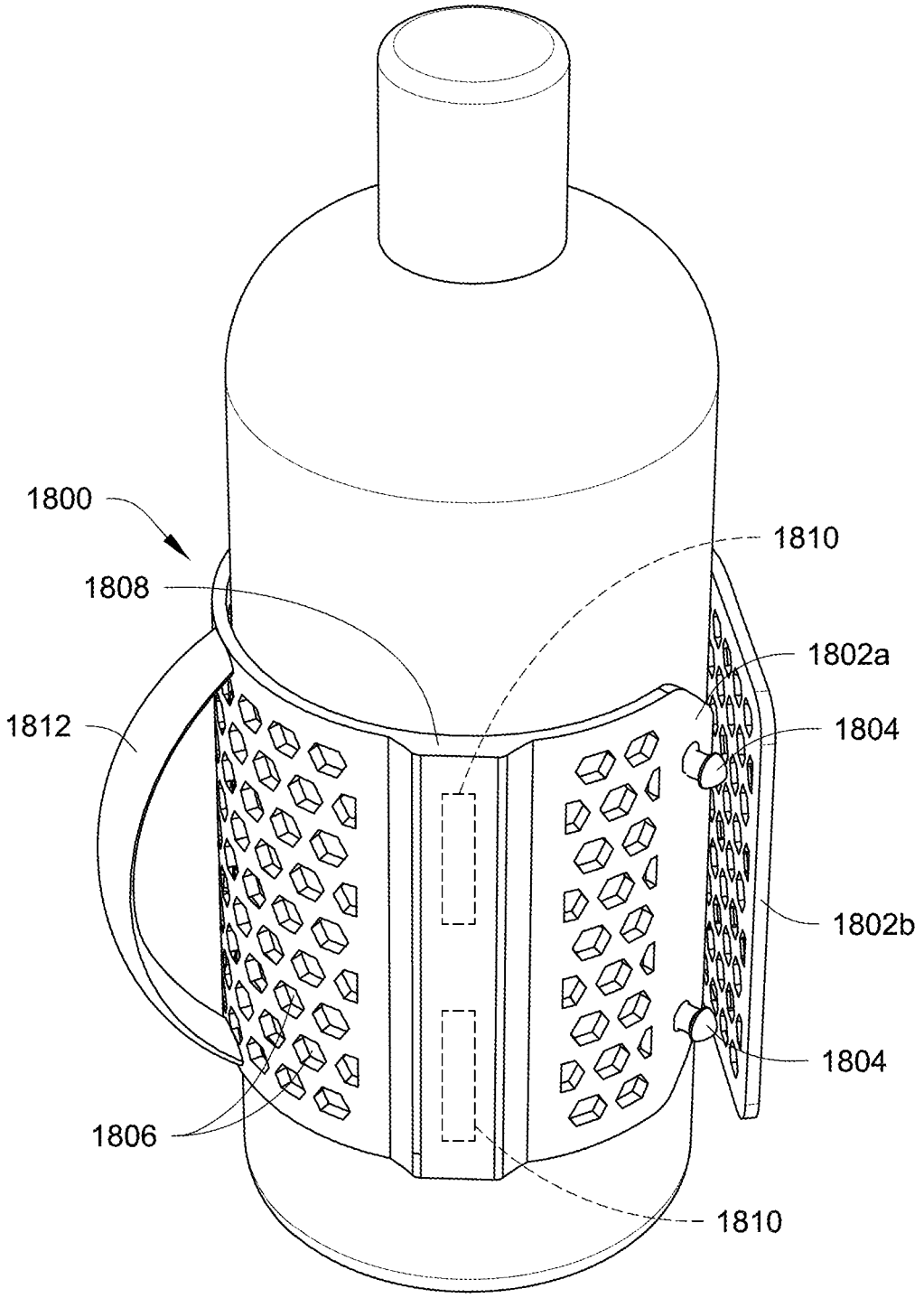
FIGS. 18-19 depict another form of a bottle sleeve configured with knobs and holes for securing the sleeve around a bottle.
Figure 19:
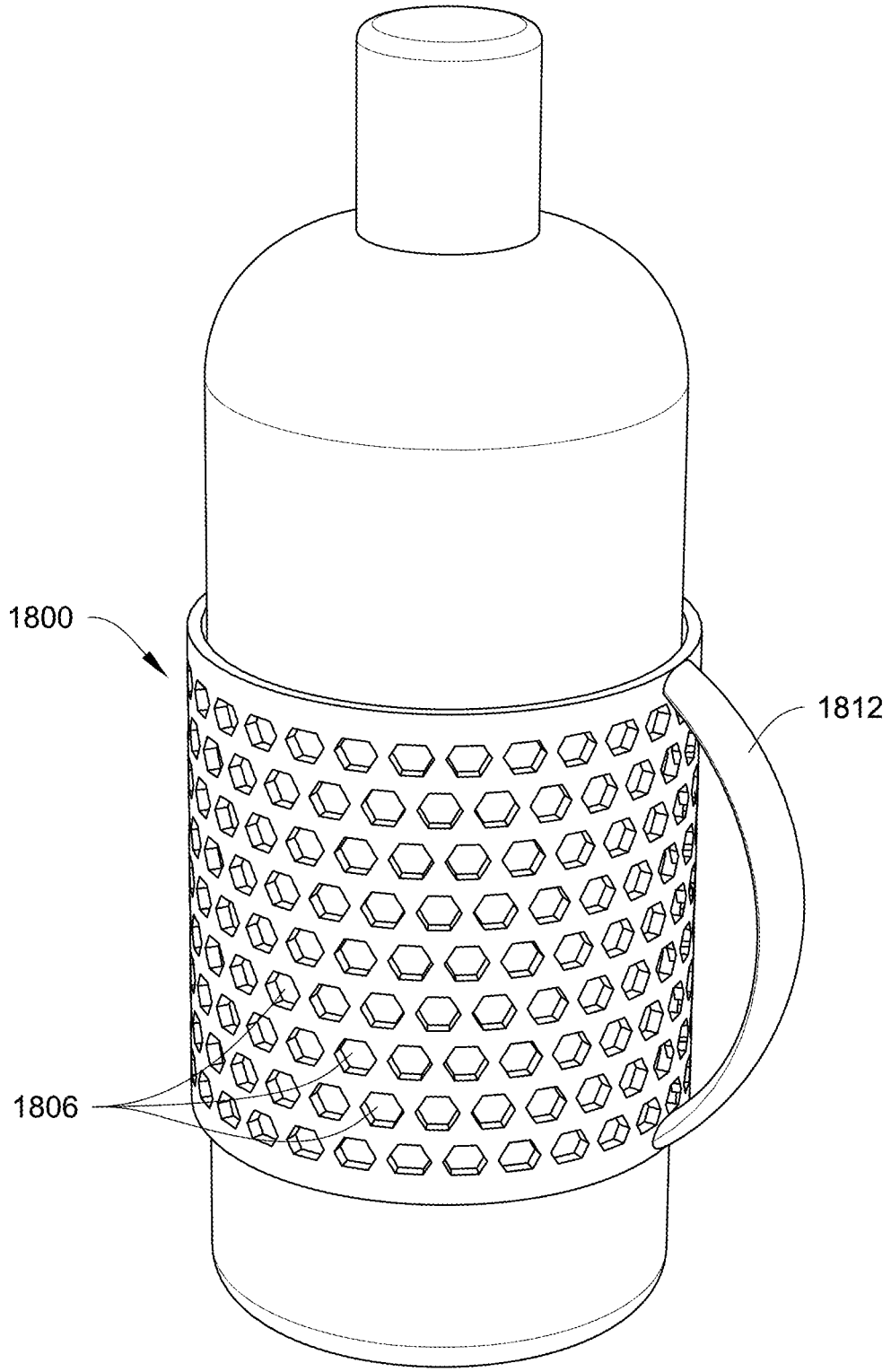

FIGS. 18-19 illustrate another example of a magnetic sleeve or wrap 1800 that can be secured around a shower item, such as a bottle, for magnetically securing the shower item. The sleeve 1800 forms a strap or band that wraps around the item and has first and second ends 1802*a*, 1802*b*. The end 1802*a* is provided with one or more knobs 1804 (which may also be referred to as mushroom shaped knobs). In addition, between the knob(s) 1804 and the end 1802*b*, the strap includes a plurality of spaced holes 1806 formed therethrough that are sized to receive the knob(s) 1804. In addition, the strap can include one or more thickened sections 1808 on the outer facing surface thereof that is thicker than the rest of the sleeve 1800. One or more magnets 1810 (shown in broken lines) are embedded within the strap, for example in the thickened section(s) 1808. In one embodiment, the sleeve may not include a thickened section(s) where the magnet(s) is embedded, or the section (s) where the magnet(s) is embedded may not be noticeably thicker than the rest of the sleeve 1800. The sleeve 1800 can be formed of any suitable water resistant grip material with a slip-resistant texture such as a polymeric or rubber material, such as polyurethane. In addition, the holes 1806 help provide a slip-resistant texture. In operation, the sleeve 1800 wraps around the shower item, with the knob(s) 1804 and the holes 1806 being used to adjust and secure the sleeve 1800 around the shower item. Once the sleeve 1800 is secured around the item, the magnet(s) 1810 serve to magnetically secure the sleeve 1800 and thus the item wrapped by the sleeve 1800 to the shower wall as described above. The knob(s) 1804 may be reinforced with a metallic insert that is surrounded by the polymeric or rubber material forming the knob(s) 1804.

In an optional embodiment, the sleeve 1800 (or any of the sleeves described herein) can be provided with a handle loop 1812 that facilitates gripping of the sleeve 1800 and the item held by the sleeve 1800. The handle loop 1812 can be formed of the same material as the sleeve 1800, such as polyurethane. The handle loop 1812 may be integrally formed with the sleeve 1800 or the handle loop 1812 may be removably attached to the sleeve 1800, for example using a knob like connection similar to the knob 1804. If a knob like connection is used, the knob may be reinforced with a metallic insert similar to the knob 1804 described above.

Figure 21:
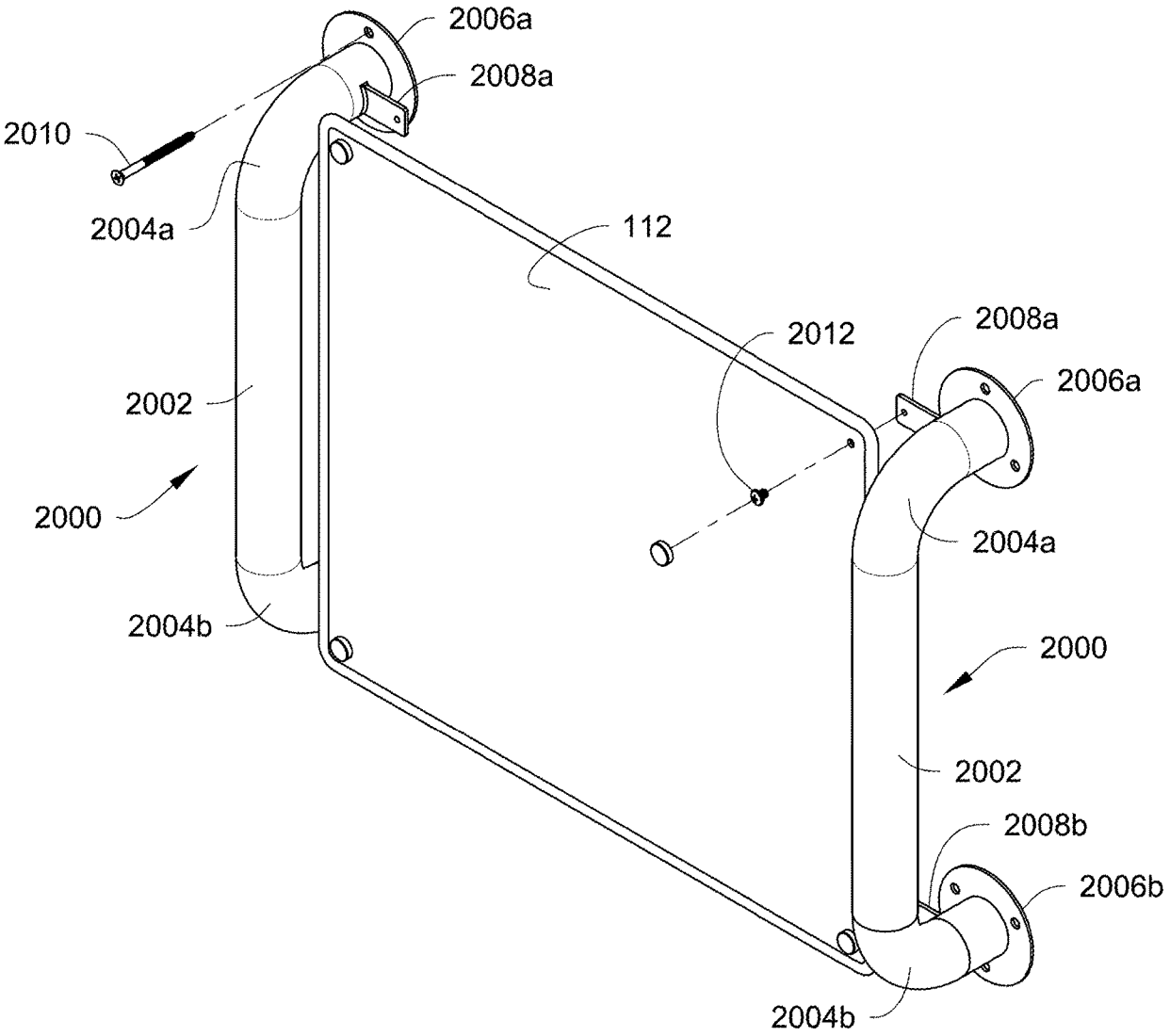
FIG. 21 depicts another embodiment where the magnetic board is attachable to a pair of grab bars.

Referring to FIG. 21, an embodiment is illustrated that includes one or more grab bars 2000, for example a pair of the grab bars 2000, attached the magnetic board 112. Items in FIG. 21 that are similar to items in FIGS. 1-20 are referenced using the same reference numerals. The grab bar(s) 2000 provide a structure for a person to hold onto while showering, as well as provide a structure for a person to hold onto while transitioning from a seated position to a standing position in the shower. In FIG. 21, the magnetic board 112 is not directly attached to the wall. Instead, the magnetic board 112 is attached to the grab bar(s) 2000 which in turn is fastened to the shower wall. For example, as shown in FIG. 21, the bar(s) 2000 include a vertical portion 2002 and a pair of attachment portions 2004*a*, 2004*b*. The attachment portions 2004*a*, 2004*b* include attachment plates 2006*a*, 2006*b* for attaching the grab bar(s) 2000 to the shower wall, for example using screws 2010. The attachment portions 2004*a*, 2004*b* further include attachment flanges 2008*a*, 2008*b*. The attachment flanges 2008*a*, 2008*b* engage the board 112 near the perimeter edges thereof for securing the board 112 to the grab bar(s) 2000. A fastener 2012, such as a screw or a bolt, can be used to secure the board 112 to the attachment flanges 2008*a*, 2008*b*. FIG. 21 depicts the board 112 as being detached from the grab bars

2000 to help illustrate and describe the concepts herein. However, in use the board 112 will be attached to the flanges 2008*a*, 2008*b*. In an embodiment, the vertical portions 2002 can include a roughened texture or include a material such as grip tape connected thereto to enhance grip.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A magnetic shower item mounting system comprising:

a magnetic board configured to be installed on a shower wall, the magnetic board having a magnetic section and an installation section; and a magnetic sleeve configured to wrap around a shower item; the magnetic sleeve having an adjustable tubular section configured to be disposed around the shower item, at least one magnetic insert encapsulated by a water resistant grip material with a slip-resistant texture;

an adjustable fastener configured to tighten the adjustable tubular section around the shower item, the adjustable fastener includes a tension portion and a control portion;

the adjustable tubular section of the magnetic sleeve comprises an open top end and an open bottom end, and the tension portion comprises a lace, a wire, or a cable wrapped at least partially around the adjustable tubular section; and wherein the control portion comprises a dial connected to the tension portion and configured to adjust a tension of the tension portion.

2. A magnetic shower item mounting system comprising:

a magnetic board configured to be installed on a shower wall, the magnetic board having a magnetic section and an installation section; and a magnetic sleeve configured to wrap around a shower item; the magnetic sleeve having an adjustable tubular section configured to be disposed around the shower item, at least one magnetic insert encapsulated by a water resistant grip material with a slip-resistant texture; and wherein the magnetic board includes one or more grab bars attached thereto.

* * * * *